US005831188A

United States Patent [19]

Amick et al.

[11] Patent Number: 5,831,188

[45] **Date of Patent: *Nov. 3, 1998**

[54] COMPOSITE SHOTS AND METHODS OF MAKING

[75] Inventors: Darryl D. Amick, Albany; John C. Haygarth, Corvallis; Lloyd Fenwick, Albany; Larry K. Seal, Solo, all of Oreg.

[73] Assignee: Teledyne Industries, Inc., Albany, Oreg.

[ * ] Notice: The term of this patent shall not extend beyond the expiration date of Pat. No. 5,527,376.

[21] Appl. No.: 839,238

[22] Filed: Apr. 17, 1997

Related U.S. Application Data

[63] Continuation-in-part of Ser. No. 323,690, Oct. 18, 1994, Pat. No. 5,527,376, and Ser. No. 474,890, Jun. 7, 1995, Pat. No. 5,713,981, which is a continuation-in-part of Ser. No. 323, 690, Oct. 18, 1994, Pat. No. 5,527,376, which is a continuation-in-part of Ser. No. 130,722, Oct. 4, 1993, abandoned, which is a division of Ser. No. 878,696, May 5, 1992, Pat. No. 5,264,022.

[51] Int. Cl.[6] ..... C22C 1/64

[52] U.S. Cl. ..... 75/246; 75/248; 102/448; 102/517; 420/122; 420/430

[58] Field of Search ..... 75/246, 248, 255; 420/122, 430; 102/448, 517

[56] References Cited

U.S. PATENT DOCUMENTS

| | | | |
|---|---|---|---|
| 3,372,021 | 3/1968 | Forbes et al. | 75/248 |
| 4,760,794 | 8/1988 | Allen | 102/517 |
| 4,881,465 | 11/1989 | Hooper et al. | 102/448 |
| 4,949,645 | 8/1990 | Hayward et al. | 102/517 |
| 5,264,022 | 11/1993 | Haygarth et al. | 75/255 |
| 5,399,187 | 3/1995 | Mravic et al. | 75/248 |
| 5,527,376 | 6/1996 | Amick et al. | 75/248 |

*Primary Examiner*—George Wyszomierski
*Attorney, Agent, or Firm*—Shoemaker and Mattare, Ltd.

[57] ABSTRACT

Methods of making high specific gravity shotgun shot and small arms projectiles from melts containing primarily tungsten and iron, and particularly including specific melting temperature depressants and using specific quenching both compositions are described and specific conditions and materials and methods for making high specific gravity shot pellets and projectiles by powder metallurgical techniques are described.

1 Claim, 3 Drawing Sheets

BINARY ALLOY PHASE DIAGRAMS

COMPOSITE SHOTS AND METHODS OF MAKING

This application is a continuation-in-part of U.S. patent application Ser. No. 08/323,690, filed Oct. 18, 1994 (now U.S. Pat. No. 5,527,376, issued Jun. 18, 1996) and a continuation-in-part of U.S. patent application Ser. No. 08/474,890, filed Jun. 7, 1995 (now U.S. Pat. No. 5,713,981, issued Feb. 3, 1998), by way of International Application No. PCT/US95/13294, with an International filing date of Oct. 18, 1995.

Ser. No. 08/474,890, filed Jun. 7, 1995 (now U.S. Pat. No. 5,713,981, issued Feb. 3, 1998), is a continuation-in-part of Ser. No. 08/323,690, filed Oct. 18, 1994 (now U.S. Pat. No. 5,527,376, issued Jun. 18, 1996); which is a continuation-in-part of Ser. No. 08/130,722, filed Oct. 4, 1993, now abandoned; which is a division of Ser. No. 07/878,696, filed May 5, 1992 (now U.S. Pat. No. 5,264,022, issued Nov. 23, 1993).

FIELD OF THE INVENTION

The present invention relates to metal shot alloys having high specific gravities and to methods for their preparation and to shot shells containing such alloy shot pellets. When compared to lead and lead alloys, these shot and shot shells are substantially non-toxic and favorably comparable in terms of their ballistic performance.

Shotshells containing lead shot pellets in current use have demonstrated highly predictable characteristics particularly when used in plastic walled shot shells with plastic shotcups, or wads. These characteristics include uniform pattern densities with a wide variety of shotgun chokes and barrel lengths, and uniform muzzle velocities with various commercially available smokeless powders. All of these characteristics contribute to lead shot's efficacy on game, particularly upland game and bird hunting. This characteristic predictability has also enabled the user to confidently select appropriate shot sizes and loads for his or her own equipment for hunting or target shooting conditions. Steel shot currently does not offer the same predictability. Each hunting season is prefaced with new commercial offerings of ammunitions to ameliorate one or more of the disadvantages associated with the use of steel shot which disadvantages include lower down-range velocities, poor pattern density and lower energy per pellet delivered to the target. Most, if not all, of these disadvantages could be overcome by the use of shot shell pellets which approximated the specific gravity of the lead or lead alloy pellets previously employed in most shot shell applications. With the increased concern for the perceived adverse environmental impact resulting from the use of lead containing pellets in shotgun shot shells there has been a need for finding a suitable substitute for the use of lead that addresses both the environmental concerns/surrounding the use of lead while retaining the predictable behavior of lead in hunting and target shooting applications.

The currently approved pellet material for hunting migratory water fowl is steel. Steel shot pellets generally have a specific gravity of about 7.5 to 8.0, while lead and lead alloy pellets have a specific gravity of about 10 to 11. This produces an effective predictable muzzle velocity for various barrel lengths and provides a uniform pattern at preselected test distances. These are important criteria for both target shooting such as sporting clays, trap and skeet as well as upland game and bird hunting. Conversely, steel shot pellets do not deform; require thicker high-density polyethylene wad material and may not produce uniform pattern densities, particularly in the larger pellet sizes. This has necessitated the production of shot shells having two or more pellet sizes to produce better pattern densities. Unfortunately, the smaller pellet sizes, while providing better patterns, do not deliver as much energy as do the larger pellets under the same powder load conditions. Also the lower muzzle velocities requires the shooter to compensate by using different leads on targets and game.

Further, the dynamics of the shot pellets are significantly affected by pellet hardness, density and shape, and it is important in finding a suitable substitute for lead pellets to consider the interaction of all those factors. However, the pattern density and shot velocity of lead shot critical for on-target accuracy and efficacy have thus far been very difficult to duplicate in environmentally non-toxic substitutes.

It has been appreciated that high density shot pellets, i.e., shot material having a specific gravity greater than about 8 $gm/cm^3$ is needed to achieve an effective range for shotshell pellets. Various methods and compositions that have been employed in fabricating non-lead shot have not yet proven to be satisfactory for all applications. While various alternatives to lead shot have been tried, including tungsten powder imbedded in a resin matrix, drawbacks have been encountered. For example, even though tungsten metal alone has a high specific gravity, it is difficult to fabricate into shot by simple mechanical forming and its high melting point makes it impossible to fabricate into pellets using conventional shot tower techniques. The attempts to incorporate tungsten powder into a resin matrix for use as shot pellets has been attempted to overcome some of these drawbacks. The February 1992 issue of *American Hunter*, pp. 38–39 and 74 describes the shortcomings of the tungsten-resin shot pellets along with tests which describe fracturing of the pellets and a loss of both shot velocity and energy giving rise to spread out patterns. Particularly, in the smaller shot size, the tungsten-resin shot was too brittle, lacking needed elasticity and, therefore, fractured easily.

Cold compaction of other metals selected for their higher specific gravity has resulted in higher density shot pellets having an acceptable energy and muzzle velocity, such as described in U.S. Pat. No. 4,035,115, but the inventions described therein still involve the use of unwanted lead as a shot component.

Still other efforts toward substitution of other materials for lead in shot have been directed to use of steel and nickel combinations and the like, particularly because their specific gravities, while considerably less than lead, is greater than the 7–8 range typical of most ferrous metals. Some of these efforts are described in U.S. Pat. Nos. 4,274,940 and 4,383,853.

Still other high density metals such as bismuth and combinations of iron, in combination with tungsten and nickel have also been suggested as lead shot substitutes. However, iron has a melting point of about 1535° C.; nickel about 1455° C. and tungsten about 3380° C. thus creating shot fabrication difficulties. None of the suggested lead substitutes except Bismuth achieve the advantageous low melting point of lead i.e. 327° C., requiring only minimal energy and cost-effectiveness in the manufacture of lead shot.

Ballistic performance equal to or superior to that of lead would be offered by a material having a specific gravity equal to or greater than that of lead.

OBJECTS OF THE INVENTION

One object of the present invention is to provide a suitable non-toxic substitute for lead shot.

Another object of this invention is to use relatively high specific gravity tungsten-containing metal alloys as small arms projectiles and shot pellets for use in shot shells, which are cost effective to produce and which can perform ballistically, substantially as well as lead and lead alloys or better, without the need to fabricate from the molten state.

Another object of this invention is to provide improved processes and products made thereby, including small arms projectiles and shot made from a range of tungsten-iron alloys, or of shot pellets of tungsten alloys or mixtures of alloys having pre-selected specific gravity characteristics.

These and other objects and advantages of the present invention are achieved as more fully described hereafter.

BRIEF SUMMARY OF THE INVENTION

It has been found that steel/tungsten (Fe/W) based alloys, such as those containing from up to about 46% or greater by weight and more preferably from about 30% to about 46% by weight of tungsten demonstrate not only a lower melting point than the melting point of tungsten, but also exhibit properties which make them particularly useful in some shot fabrication processes. The steel-tungsten alloys of the present invention, when formed into spherical particles of preselected shot diameters, are superior to currently available steel shot and can exhibit ballistic and other properties which can be comparable to conventional lead shot.

Additionally, alloys of the same or higher tungsten content, although fusible, are more easily brought to useful shape by the techniques of powder metallurgy. In contrast to the iron-tungsten system, in which interaction between the metals lowers the liquidus temperature below that of pure tungsten, in some systems, such as tungsten-copper, there is little interaction, and the liquidus is not lowered by addition of the second metal. For these systems, powder metallurgy is ideally suited to the mass-production of small parts to precisely-controlled shape and dimensions. According to the present invention, it is possible to produce spheres of diameter as small as 0.070" or smaller, and up to 1" or more if desired. For use as shot, these spheres optionally may be plated with copper or zinc, or coated with lubricant such as molybdenum disulfide, graphite, or hexagonal boron nitride, if desired, for specific functional characteristics.

BRIEF DESCRIPTIONS OF THE DRAWINGS

DETAILED DESCRIPTION OF THE INVENTION

Figure 1:
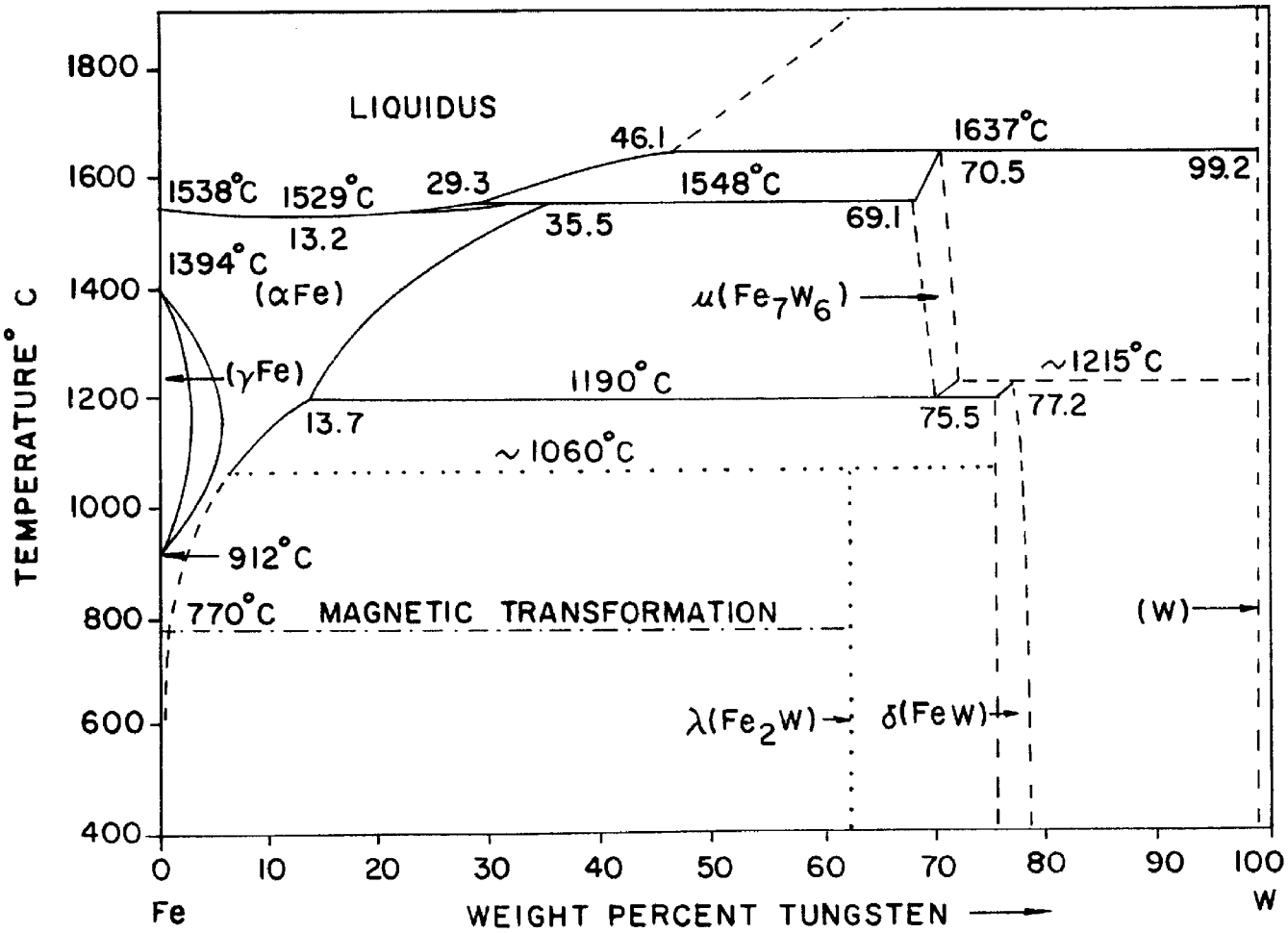
FIG. 1 is a phase diagram of the Fe/W alloys used herein.

Steel-tungsten alloys, containing from about 30% to about 85% by weight of tungsten and preferably from about 30% to about 70% by weight of tungsten and most preferably 40% to 65% by weight tungsten and from 60% to 35% by weight iron can be formed into pellets suitable for use in shot shells by fabrication from the molten state or by powder metallurgical processes. These pellets can have specific gravities in the range of from about 8 to above 12 and preferably at least 10 gm/cc. The pellets when formed from the molten state are prepared by a process consisting essentially of heating the binary alloy of steel-tungsten to a temperature about 1548° C., then increasing to not less than about 1637° C. at which temperature the alloy evolves into a liquids phase when the tungsten is present in an amount of up to about 46.1%. The heated liquid alloy is then passed through refractory sieves having holes of a sufficient diameter, spaced appropriate distances apart to obtain the desired shot size, or quenched under specific conditions described hereinafter. Unwanted high viscosity is avoided by controlling molten alloy temperature and the resulting sieved alloy falls about 12 inches to about 30 inches, through air, argon, nitrogen or other suitable gas into a liquid such as water at ambient temperature, causing the cooled shot to form into spheres of desired sizes. Though generally of the desired shape, they can be further smoothed and made more uniform by mechanical methods such as grinding, rolling, or coining.

EXAMPLE 1

Shot or pellet types of the present invention having different sizes are obtained by first melting the Fe/W alloys.

A 200-g vacuum-arc melted button was prepared from 0.18% Carbon steel turnings an W powder ($C_{10}$ grade). The dissolution of the W was both rapid and complete as indicated by a metallographic section. The alloy was predetermined to be 60wt %Fe/40wt %W having a calculated density of 10.3 g/cm. This compared favorably to its actual density measured at 10.46 g/cm$^3$. Conventional lead shot is 97Pb/3Sb or 95Pb/5Sb which has a density of 11.1 gm/cm$^3$ or 10.9 gm/cm$^3$, respectively.

A larger quantity of the above alloy was melted and poured through porcelain sieves of various hole sizes and spacings, then allowed to fall through a distance of air and ambient temperature water to produce about 3.1 pounds of shot.

Molten alloy at 3000°–3100° F. was poured into a "water glass"-bonded olivine funnel containing a porcelain ceramic sieve and suspended 12" above a 6" I.D. Pyrex column containing 60" of 70° F. water. The column terminated at a Pyrex nozzle equipped with a valve through which product could be flushed into a bucket. The porcelain ceramic sieve (part number FC-166 by Hamilton Porcelains, Ltd. of Brantford, Ontario, Canada) had been modified by plugging 58% of the holes with castable refractory to obtain a pattern of holes 0.080" dia. separated by spacings of approximately 0.200". Although an oxyacetylene torch was used to preheat the funnel/sieve assembly, a melt temperature of 1685° C. resulted in very little flow through the sieve because of rapid radiative heat loss in the need for transporting molten metal from furnace-to-ladle-to-funnel in the experimental set-up employed. Increasing the melt temperature to 1745° C. resulted in rapid flow through the sieve for approximately 15 seconds, resulting in the product described in Table 1 in terms of the particle size in contrast to the shape.

TABLE 1

| Size Distribution | | |
|---|---|---|
| Size, in | Wt., lb. | Wt % |
| −½ +¼ | 1.90 | 62.1 |
| −¼ +0.157 | 0.85 | 27.8 |
| −0.157 +0.055 | 0.30 | 9.8 |

TABLE 1-continued

| Size Distribution | | |
|---|---|---|
| Size, in | Wt., lb. | Wt % |
| −0.055 | 0.01 | 0.3 |
| | 3.06 | 100.0 |

A sample of the −0.157"/+0.055" fraction was mounted polished, and etched to reveal microstructural details and microporosity.

It was found that Fe/W alloy is particularly effective in forming relatively round, homogeneous diameter particles of ≦0.25" which become spherical in a free fall through about 12" of air, then through about 60" of water at ambient temperature (70° F.).

It is believed that the pellet diameter is not strictly a function of the sieve hole diameter because droplets of spherical shape grow in diameter until a "drip-off" size is achieved. In addition, if the viscosity of he melted alloy is too low, multiple streams of metal will low together forming a liquid ligament.

This desired viscosity can be controlled by adjusting he temperature of the molten alloy to achieve the desired hot formation. That is, avoiding merging streams and tear drop shapes. This can be accomplished without undue experimentation with the specific equipment or apparatus sued by maintaining its temperature high enough so that at the point where the liquid metal enters the sieve its surface tension will cause the formation of spherical droplets from the sieve.

By controlling the alloy melt and the sieving temperature, so-called ligaments or elongated shot are avoided as well as other anomalous sizes and shapes caused by unwanted high viscosity.

The present invention overcomes many of the disadvantages of steel shot previously described, including less than desirable pattern density. Even though various pellet sizes can be used for steel shot shells, because the specific gravity of Fe is 7.86, its ballistic performance results for any given size is characterized by decreased force or energy, compared to lead and lead alloys.

In overcoming this, the present invention includes cartridges of multiple shot sizes such as the so-called duplex or triplex combinations of different pellet sizes presently commercially available, which are said to increase the pattern density of the pellets delivered to a test target. By preselecting a particular distribution of shot sizes, i.e., diameters, and the proportion of the different sizes of pellets within the cartridge, an appropriate or desired pattern density can be achieved with a high degree of accuracy and effectiveness.

In addition, the pellet charge of the present invention consist of various sized shot and include mixtures of both high and low specific gravity alloy pellets of different diameters.

Heretofore, lead shot provided the standard against which accuracy was measured generally using only one size pellet. Lead-free shot pellets made of the Fe/W alloys of the present invention possess advantages both over toxic lead pellets and other metals substituted as replacements. This is particularly so because the different specific gravities in the mixture of shot pellets sizes, easily produced by the processes disclosed herein, provide a superior pattern density and relatively uniform delivered energy per pellet.

By providing a predetermined pellet mix of two (duplex) or three (triplex) or more pellet combinations of varying diameters and varying densities or specific gravities, both the pattern density over the distance between discharge and on the target and the depth of impact of the smaller shot is improved. The energy of the shot combination is improved because there is little shot deviation on firing. The increased drag forces (per unit volume) encountered by a relatively smaller particle at a given velocity in air may be offset by constructing such a particle from alloy of a relatively higher specific gravity. The larger diameter steel shot on the other hand with a larger diameter and less specific gravity if correlated as described hereinafter to the smaller size Fe/W shot.

Appropriate selection of shot sizes and the specific gravity of the alloys used for the various shot sizes can provide for the same energy delivered by each size to a preselected target. This can most graphically be demonstrated by the gelatin block test, etc. This will provide a significant improvement over the present use of steel pellets of the same specific gravity and different diameters used in the so-called "duplex" and "triplex" products. Because their diameters differ, shot pellets of the same specific gravity will exhibit different ballistic patterns.

By determining the drag force of spheres, such as round shot pellets, traveling through a fluid, such as air, the drag forces of different metals having different radii and specific gravities can be determined.

$$\text{Drag Force} = (\pi R^2)\frac{(\rho V^2)}{2} f$$

where R=radius, ρ=density or specific gravity, V=velocity and f=friction factor (a function of several variables including Reynolds number, roughness, etc.).

The drag forces per unit volume for both steel shot and FeW shot are determined and equated according to the following $$\frac{R_1}{R_2} = \sqrt{\frac{\rho_1}{\rho_2}}$$

where $R_1$, $\rho_1$ refer to steel and $R_2$, $\rho_2$ refer to FeW alloy containing 40 wt. % W, then $$R_1 = R_2\sqrt{\frac{10.3}{7.86}} \quad \text{or } R_1 = R_2 \times 1.15$$

By this method, the following mixes (duplex) of two pellet sizes and compositions are obtained, and presented as examples.

| Mixture | Steel Shot Sizes | Iron-40% Tungsten Shot Sizes |
|---|---|---|
| #1 | #6 (0.11" dia.) | #7½ (0.095" dia.) |
| #2 | #4 (0.13" dia.) | #6 (.11" dia.) |
| #3 | #2 (0.15" dia.) | #4 (.13" dia.) |
| #4 | BB (0.18" dia.) | #2 (.15" dia.) |

It is contemplated that various other specific methods of melting various material configurations of iron and tungsten together or separately and then mixed, can successfully be employed in the practice of the present invention.

Further, improvements in the ballistic performance rust prevention and abrasiveness to steel barrels can be achieved by coating the pellets of the present invention with a suitable layer of lubricant or polymeric or resinous material or surface layer of a softer metal. The mixed shotshell pellets where steel alone is the material of choice for one or more of the pellet sizes may also advantageously be coated as described herein to improve resistance to oxidation. The covering or coating can be of any suitable synthetic plastic or resinous material softer metal layer, that will form an oxidation resistant or lubricant film which adheres to the pellets. Preferably, the coating should provide a non-sticking surface to other similarly coated pellets, and be capable of providing resistance to abrasion of the pellet against the steel barrel. Typically suitable materials can be selected from petroleum based lubricants, synthetic lubricants, nylon, Teflon, polyvinyl compounds, polyethylene polypropylene, and derivatives and blends thereof as well as any of a wide variety of elastomeric polymers including ABS polymers, natural and synthetic resins and the like. Coatings may be applied by methods suitable to the materials selected which could include hot melt application, emulsion polymerization, solvent evaporation or any other suitable technique that provides a substantially uniform coating that adheres well and exhibits the previously described characteristics. The application of a metal layer will be more fully described hereinafter particularly with respect to pellets formed by powder metallurgical processes.

In addition, the shot shells of the present invention can employ buffering materials to fit either interstitially with the shot charge or not, depending on the performance parameters sought. Granules of polyolefins or polystyrene or polyurethane or other expanded or solid materials can be utilized and some have been employed in conventional lead and lead alloy and steel shot charges in shot shells. Such buffering with or without shot coatings may advantageously be employed to add dampening and shot and barrel lubrication properties. The shot shells of the present invention can be fabricated with or without conventional shotcup wads.

In the preferred practice of the present invention, it has been found that it is possible to fabricate the articles described herein in to the desired shapes by pressing metal or alloy powder or a mixture of the metal or alloy powders, with or without a binder or lubricant, optionally treating to remove surface imperfections resulting from the pressing, then sintering at elevated temperature in vacuum, or in hydrogen, nitrogen, or in an inert gas such as argon for a period of ranging from minutes to several hours, with or without a prior separate step to remove the binder or lubricant, then if necessary grinding to final size and to final shape to produce the aforementioned projectiles or parts thereof.

The compositions of the alloys from which the projectiles are made are based on binary alloys of tungsten with iron, with other suitable metals preferably copper, to which minority components may be added with advantage.

Powders from which the to-be-sintered pressings are made may be produced by comminution then mixing of alloys prepared from alloys different from the desired composition, by mixing an elemental end-member in powder form with a powder prepared from an alloy different from the desired composition, or by mixing of elemental powders. Such powders may be used without additives, or may contain up to several parts per hundred by weight of binders and lubricants such as paraffin wax, and/or of fluxes. In particular, powders from which the pressings are made may be prepared from mixtures of powders prepared by comminution of ferrotungsten alloys of various composition, with, if necessary, admixture of iron powder or tungsten powder or of a powder of ferrotungsten alloy of a different composition, so that the desired powder composition might be achieved. Likewise, tungsten-aluminum alloy powders of desired composition may be made by comminution of tungsten-aluminum alloys, or the desired powder composition may be obtained by mixture of appropriate tungsten-aluminum alloy powders of different compositions. Tungsten-copper powders may be made for example, by mixing elemental powders or by co-reducing mixtures of tungsten oxide and copper oxide with hydrogen, or by depositing copper on tungsten powder by electrolytic reduction or by an electroless coating process. Tungsten-copper powders advantageously may contain additions such as nickel or iron. Tungsten-iron powders may advantageously contain nickel and/or silicon at the level of a few percent.

It will be appreciated by those skilled in the art, that whereas articles comprised predominately of iron and tungsten, prepared from alloys in the molten state, or from powders sintered at high temperatures will have at least part, and in some cases all, of their tungsten attribute present as intermetallic compounds such as $WFe_2$ and $W_6Fe_7$. Articles prepared by sintering at lower temperatures of powder mixtures in which the tungsten attribute is present as elemental tungsten will have most, and in some cases all, of their tungsten attribute present as elemental tungsten. Both materials containing tungsten partly or totally present as the element, are capable of exhibiting useful values of density and of other mechanical properties, and are included among materials of interest for fabrication of shot and other small-arms projectiles.

Powders, including those prepared as described hereinbefore, preferably having a median particle size of 150 microns or less, may be pressed to shape as mixed or may be agglomerated, or pre-compacted and granulated, in a variety of ways familiar to those skilled in the art, prior to pressing to shape.

Shapes such as spheres, and other shapes of interest in the production of projectiles or of projectile parts, may be prepared by compaction of any of the described powders. This pressing may be done in any of a variety of commercially available machines, such as the Stokes DD-S2, a 23 station, 15-ton rotary press, or the Stokes D-S3, a 15-station, 10-ton rotary press, both of which can be equipped with shaped punches and insert dies suitable for production of the shapes desired. Such machines may be adjusted to deliver the pressing force and the duration of the pressing force required for the part to be produced.

If desired, the pressed parts may be treated before sintering to remove surface imperfections. For example, the equatorial "belt" on pressed balls seen in FIGS. 2 and 3 may be removed by shaking the pressings on a sieve screen or other rough surface. The pressed parts may be optionally exposed to a treatment, usually combining reduced pressure and increased temperature, for removal of the binder prior to sintering. Frequently though, this step is combined with the sintering step. Sintering may be conducted at temperatures of 1000° C. or lower to 1600° C. or higher, for less than one hour to more than eight hours, either batch-wise or continuously, with slow or rapid heating and/or cooling, in vacuum, in a hydrogen atmosphere or a nitrogen atmosphere or in any of several inert gas atmospheres such as helium or argon. After sintering, if necessary, the parts may be submitted to a grinding process, or may be tumbled in a mill, or honed in a vibro-hone to remove undesirable surface features. In the case of spheres, the "belt" acquired during some types of pressing operations may be removed using machines such as the Cincinnati Bearing Grind or the Vertisphere 16/24 ball-lapping machine, to produce smooth spherical parts. optionally after these operations, the parts may be cleaned, then coated, plated, and/or provided with lubricant.

Specific examples of the powder metallurgical process for production of shot from mixtures of iron and tungsten powders or from mixtures of iron powder and tungsten-iron alloy powders are described hereinafter. These are exemplary only, and are not intended to be exclusive. Indeed, the extension to other shapes, and to the other alloy systems mentioned, will be clearly apparent to those skilled in the art.

EXAMPLE 2

Figure 3:
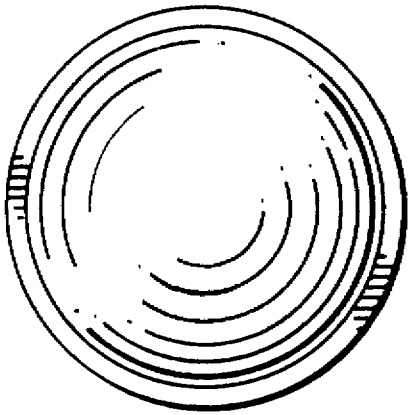
FIG. 3 is an end view of the pellet of FIG. 2.
Figure 2:
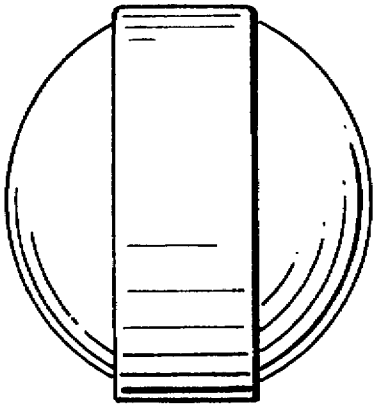
FIG. 2 is a plane view of a pellet made according to one embodiment of the present invention.

Tungsten powder, 9 lb, grade C-5, 1.3 $\mu$m median particle size from Teledyne Advanced Materials, was mixed with iron powder, 6 lb either grade R-1430 from International Specialty Products (ISP), Huntsville, Ala., or grade CM from BASF of Parsippany, N.J., to give a mixture containing 60 mass %W and 40 mass % Fe. To this was added 0.15 lb Acrawax C lubricant from Glyco, Inc., and the whole, of mass 15.15 lb, was placed in a 0.5 cu. ft. V-cone blender, which was then sealed and rotated at 0.5 rpm for 120 min. A similar batch was prepared, identically, using iron powder. The mixture was then used to prepare a quantity of belted spherical pellets, of diameter 0.197" as shown in FIGS. 2 and 3, using a Stokes DD-52, 23 station, 15-ton rotary press, equipped with appropriate dies and punches. The pellets were subjected to a treatment to remove the Acrawax lubricant, consisting of heating to 400° C. in a vacuum of 50 micron of mercury or better, and maintaining these conditions for three hours. In commercial practice, this could be done in the sintering furnace as the first stage of the sintering process. Pellets so produced were then placed in an electric furnace equipped with molybdenum elements, and sintered in flowing hydrogen at one atmosphere pressure by heating at 1000° C./hr to either 1450° C. or 1500° C., which temperature was held for one hour, after which the furnace was turned off and allowed to cool to room temperature. Sintering temperatures, densities, crushing-strengths and other data for the pellets so obtained are given in Table 2 as runs 1 through 4.

EXAMPLE 3

Tungsten powder, 9 lb, grade M-30, 2.1 $\mu$m median particle size, from Sylvania, was mixed with 6 lb grade of either ISP R-1430 iron powder or BASF grade CM iron powder and 0.15 lb Acrawax lubricant added. A similar batch was prepared, identically, using iron powder. The mixture was blended, pressed, heated to remove the Acrawax, and sintered as described in Example 2. Resulting temperatures and crushing loads are given in Table 2 as runs 5–8.

EXAMPLE 4

Tungsten powder, Grade C-6, from Teledyne Advanced Materials, was mixed with carbonyl iron powder grade CM from BASF. Two lots were prepared, one containing 45 mass % tungsten and the other, 55 mass % tungsten. Each mixture was blended in a Patterson-Kelley V-cone blender fitted with an intensifier-bar until the temperature of the blender shell reached 180° F., whereupon molten paraffin wax, in amount 2 weight % of the mixed powders was added, and blending continued for two hours. The mixtures were granulated by hydrostatically compacting at 27,000 psi followed by crushing and screening to pass 20 mesh but to be retained on 46 mesh. These powders were pressed to form pellets, treated to remove the paraffin wax lubricant, and sintered all as in Example 2, whereupon the densities and crushing strengths were measured. Details are given in Table 2, as runs 9, 10, 11, and 12.

TABLE 2

SINTERING TEMPERATURES, COMPOSITIONS, AND SOME PROPERTIES OF SOME TUNGSTEN-IRON AND TUNGSTEN-COPPER SHOT PREPARATION

| Run No. | Example No. | Composition Mass % | Iron Powder Type | Sintering Temp., °C. | Density, Meas., gm/cc | Density, Calc, g/u | Crushing Strength psi |
|---|---|---|---|---|---|---|---|
| 1 | 2 | 60 W, 40 Fe | ISP | 1450 | 9.93 | 12.20 | 680 ± 160 |
| 2 | 2 | 60 W, 40 Fe | ISP | 1500 | 11.90 | 12.20 | 550 ± 30 |
| 3 | 2 | 60 W, 40 Fe | BASF | 1450 | 9.52 | 12.20 | 690 ± 150 |
| 4* | 2 | 60 W, 40 Fe | BASF | 1500 | 11.75 | 12.20 | 890 ± 30 |
| 5 | 3 | 60 W, 40 Fe | ISP | 1450 | 8.26 | 12.20 | 560 ± 30 |
| 6 | 3 | 60 W, 40 Fe | ISP | 1500 | 10.91 | 12.20 | 760 ± 20 |
| 7 | 3 | 60 W, 40 Fe | BASF | 1450 | 8.00 | 12.20 | 430 ± 20 |
| 8 | 3 | 60 W, 40 Fe | BASF | 1500 | 9.21 | 12.20 | 580 ± 40 |
| 9 | 4 | 45 W, 55 Fe | BASF | 1450 | 10.76 | 10.72 | 1370 ± 60 |
| 10 | 4 | 45 W, 55 Fe | BASF | 1500 | 10.88 | 10.72 | 1400 ± 34 |
| 11 | 4 | 55 W, 45 Fe | BASF | 1450 | 11.33 | 11.66 | 1200 ± 20 |
| 12 | 4 | 55 W, 45 Fe | BASF | 1500 | 11.60 | 11.66 | 1260 ± 150 |
| 13* | 5 | 50 W, 50 Fe | ISP | 950 | 8.7 | 11.17 | 840 ± 80 |
| 14 | 6 | 62.6 W, 37.4 Fe | ISP | 1550 | 11.67 | 12.50 | 670 ± 80 |
| 15 | 7 | 48 W, 52 Cu | — | 1160 | 11.00 | 12.04 | |

*Phases present in sintered pellets:
Run 4 $Fe_2W$, $W_6Fe_7$ and W; no Fe detected.
Run 13 $\alpha$ Fe and W; no $W_6Fe_7$ or $Fe_2W$ detected.

TABLE 3

SHOT PENETRATION TESTS

| Shot Type | Size | Mass, gm | Density gm/cc | 1/4" Plywood-Penetration | Deformation | Pattern Full Chokes 40 yards, 30" circle |
|---|---|---|---|---|---|---|
| W-Fe Unground | .197 | 0.65 | 9.8 | 4 1/3 sheets-1–66, 2–66, 3–65, 4–61, 5–24 | Broke 3 of 66 pellets recovered | N/A |
| Lead BB | .180 | — | 11.1 | 2 1/2 sheets-1-45, 2–42, 3–32 | Severe (all pellets) | 80% (manufacturer's claim) |
| Steel BB | .180 | 0.39 | — | 2 1/2 sheets-1–51, 2–45, 3–39 | Moderate-heavy 0.12" dia. flats on recovered pellets | N/A |
| Steel T | .200 | 0.54 | — | 2 1/4-1–38, 2–33, 3–31 | Moderate 0.6" diam. flats on recovered pellets | N/A |
| W-Fe Ground BB Spherical | .180 | 0.51 | 10.0 | 4 1/8-1–62, 2–56, 3–57, 4–53, 5–16 | None | 88% |
| W-FE Unground | .115 | | 11.04 | −1/3 depth of 1st sheet (0.08 inch) | None | N/A |

EXAMPLE 5

Figure 5:
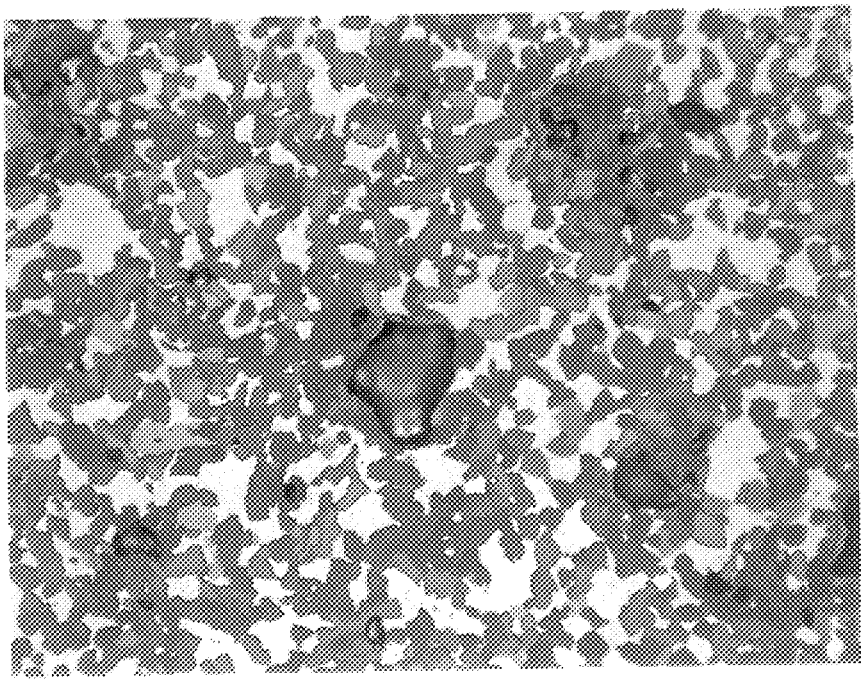
FIG. 5 is a photomicrograph of another embodiment of the present invention.

Tungsten powder, 1 lb, grade C-10 from Teledyne Wah Chang Huntsville was mixed with iron powder, 1 lb, grade R-1430 from ISP, and Acrawax C lubricant, 0.02 lb, added. The ingredients were mixed as in Example 2, pressed to form pellets, and dewaxed and sintered in flowing nitrogen by introducing the boat containing the pellets into the furnace hot zone so that the temperature rose to 950° in 15 minutes, then removing it to a cold zone after a further 30 minutes had elapsed. Density, and crushing-strength data as well as phases present are given in Table 2, run 13. A photograph of the microstructure of the metallographically prepared cross section of one of the pellets is shown in FIG. 5, in which only iron and tungsten phases can be observed.

EXAMPLE 6

Ferrotungsten powder, 1 lb, −230 mesh, 78.3 weight % tungsten from H. C. Starck, was mixed with iron powder, ISP grade 1430, 0.20 lb to which Acrawax C lubricant, 0.012 lb, had been added. Pellets as shown in FIGS. 2 and 3 were then pressed and subjected to lubricant removal as described in Example 2, then sintered at 1500° C. as described in Example 2. Results are summarized in Table 2 as run 14, Example 6.

EXAMPLE 7

Metco grade 55 copper powder, 140.4 gm, was mixed with 129.6 gm of grade C-10 tungsten powder, median particle size 4–6 microns from Teledyne Advanced Materials, and the mixture blended in a WAB Turbula type T2C, laboratory-scale mixer. No lubricant was used. The mixture was pressed at 3000 psi to make pellets of diameter 0.115" dia., which were placed in an alumina boat. The boat was placed in a silica tube, inside diameter 1", which was installed in a horizontal tube furnace and through which hydrogen was passed at 1 liter/min. The temperature was raised to 1160° C. and held for 2½ hours, then allowed to fall to room temperature by interrupting the power supply to the furnace and opening it. The results are given as Run 15 in Table 2.

The following examples illustrate the production of shot particles by sintering with the use of a combination of ferrotungsten and iron powder where the larger powder particles make very effective products.

EXAMPLE 8

This example illustrate the effect of the particle size distribution of the ferrotungsten powder. Ferrotungsten powder containing 83% tungsten from H. C. Starck was used. A particle size analysis of ferrotungsten powder is given in Table 4.

TABLE 4

| | | | | | |
|---|---|---|---|---|---|
| Size range U.S. sieve | +100 | −100 + 200 | −200 + 325 | −325 + 400 | −400 |
| Size range microns | +150 | −150 + 75 | −75 + 45 | −45 + 38 | −38 |
| Wt % in size range | 0.2 | 33.0 | 23.3 | 16.9 | 26.6 |

The iron particles used were from Hoeganaes Co., grade ANCOR ATW 230 and were very fine. From a sieve analysis, there were no particles retained on a 100 mesh screen and thus all the particles were less than 150 micron. There was 0.8 wt. % retained on 325 mesh (i.e., 45 microns or larger) and the balance were finer. The apparent density was 2.96 gm/cc and the chemical analysis was <0.1% carbon, 0.027% sulfur and a hydrogen loss of 0.48%.

The ferrotungsten powder and iron powder were combined to give a mixture of 75 wt. % ferrotungsten powder, 25 wt. % iron powder and mixed with 1 wt. % Acrawax. This was pressed as in Example 2 to give 0.197 inch diameter balls, and dewaxed in vacuum and sintered near 1548° C. for 60 minutes. Three experiments were conducted with each of three samples of ferrotungsten selected to have different particle-size distributions. These were (A) −100 mesh, i.e., all the material passing through the 100 mesh sieve (B) −100 +270 mesh, and (C) −270 +325 mesh. The results are given in Table 5.

TABLE 5

| Size range U.S. sieve (microns) | Density g/cc | Crushing load, lb |
|---|---|---|
| (A) −100 mesh (−150) | 10.52 ± 0.16 | 680 ± 63 |
| (b) −100 + 270 mesh (−150 + 53) | 10.70 ± 0.03 | 467 ± 23 |
| (c) −270 + 325 mesh (−53 + 45) | 10.20 ± 0.05 | 383 ± 17 |

The crushing load is used to determine the ultimate strength of the material. The data in Table 5 shows that while ferrotungsten particle size has only a slight effect on density, its effect on crushing load is very large, and that the best strength, and within experimental uncertainty, the best density is obtained with powder (A) which is made of the largest range of particle sizes.

From an analysis of other data, an approximate correlation has been found for the relationship between crushing load for the balls and the crushing strength of the material which is given by the formula strength (psi)=crushing-load (lb)×(130 ±10) For example, one could determine the crushing load needed to exhibit a given crushing strength. To exceed a crushing strength of 45,000 psi, one could use a conservative factor of 130−10=120 and solve the equation such that the crushing load for the ball is 45,000/120=375 lb.

EXAMPLE 9

This experiment illustrates the effect of the ratio of iron powder to ferrotungsten powder. The powder of Example 8 was used and the particle size distribution of the ferrotungsten powder is given in Table 4. This powder was mixed in proportions varying from 25 wt % iron, 75 wt. % ferrotungsten to 55 wt % iron, 45 wt. % ferrotungsten. The ferrotungsten contained 83 wt. % tungsten and the amount of tungsten (W) in the metal mixture is given in Table 6. As in Example 8, Acrawax in an amount of 1% of the total weight was added to the mixture, and 0.197 inch diameter balls were pressed from the mixed powders. The wax was removed either by the heating in the vacuum procedure of Example 8, or by heating in flowing hydrogen. The experiments presented below will show that there is no difference in outcome between these alternative procedures. The balls were then sintered as in Example 8 at temperatures in the range of 1500° to 1550° C. for 60 minutes, and the density and crushing strength were measured. The results are given in Table 6.

TABLE 6

| Iron wt % | W wt % | Dewaxing mode | Sintering temp °C. | Density gm/cc | Crushing load lb |
|---|---|---|---|---|---|
| 25 | 62.2 | vacuum | 1549 | 10.52 ± 0.16 | 679 ± 64 |
| 30 | 58.0 | vacuum | 1537 | 10.65 ± 0.05 | 595 ± 72 |
| 35 | 53.9 | hydrogen | 1541 | 10.84 ± 0.31 | 834 ± 33 |
| 40 | 49.7 | hydrogen | 1535 | 10.97 ± 0.08 | 978 ± 24 |
| 45 | 45.6 | hydrogen | 1537 | 10.93 ± 0.10 | 1114 ± 34 |

TABLE 6-continued

| Iron wt % | W wt % | Dewaxing mode | Sintering temp °C. | Density gm/cc | Crushing load lb |
|---|---|---|---|---|---|
| 50 | 41.5 | hydrogen | 1531 | 10.61 ± 0.02 | 1224 ± 18 |
| 55 | 37.3 | hydrogen | 1535 | 10.19 ± 0.09 | 1414 ± 21 |

These results show that while the crushing strength increases sharply with iron content above 30 wt. % iron, the density exhibits a gentle maximum between 35 and 45 wt. %.

EXAMPLE 10

This experiment illustrates the effect of sintering temperature on density and strength. For the ferrotungsten a −230 mesh fraction (−63 microns) of ferrotungsten was used which contained only 75 wt. % tungsten, rather than the 83 wt. % tungsten containing ferrotungsten of Example 8. The same iron powder of Example 8 was used. The powders were mixed along with the additional 1 wt. % Acrawax as in the previous example to give a powder containing 30 wt. % iron and 70 wt. % ferrotungsten. The amount of tungsten was 52.5 wt. %. This was pressed as in Example 9 to give 0.197 inch diameter balls which were sintered for one hour in hydrogen at 1483° C. or 1541° C. The density and crush-loading were measured and are given in Table 7.

TABLE 7

| Sintering temp °C. | Density g/cc | Crushing load, lb |
|---|---|---|
| 1483 | 9.40 ± .08 | 465 ± 21 |
| 1541 | 10.67 ± .48 | 717 ± 52 |

Similar balls were pressed from a mixture containing 70 wt. % −100 mesh ferrotungsten (−150 microns) as characterized in Table 4, and 30 wt. % iron powder as in Example 8 above. These were sintered for one hour at 1471° C. or 1537° C. Densities were measured for all the balls, but crushing load were measured only for those sintered at the higher temperature. Results are given in Table 8.

TABLE 8

| Sintering temp °C. | Density g/cc | Crushing load, lb |
|---|---|---|
| 1471 | 9.89 ± .06 | — |
| 1537 | 10.66 ± .07 | 611 ± 73 |

The results given in Tables 7 and 8 show that both density and strength are strongly dependent on sintering temperature for sintering times of one hour, and that temperatures in the range of 1470°–1485° C. do not produce adequate strength or density. However, when mixture containing 40 wt. % iron powder, of the kind specified in Example 8 and 60 wt. % −100 mesh ferrotungsten powder as described in Table 4, are pressed and sintered, adequate strengths may be had at temperatures near 1500° C. Thus, 0.197 inch diameter balls, pressed from a powder mixture as described above and sintered at 1494° C. or 1535° C. gave results shown in Table 9.

TABLE 9

| Sintering temp °C. | Density g/cc | Crushing load, lb |
|---|---|---|
| 1494 | 10.73 ± .02 | 954 ± 28 |
| 1535 | 10.98 ± .08 | 978 ± 24 |

Thus, when the iron content is near the optimum value of 40%, adequate strengths and densities are achieved at temperatures near 1500° C., although slightly better properties are obtained near 1540° C. The upper limit of sintering temperature for these mixtures is probably near 1548° C., the solidus temperature in this composition range, but the lower temperature limit ranges from somewhat below 1500° C. at and above 40 wt. % iron to higher temperatures at lower iron contents.

EXAMPLE 11

This experiment illustrates the effect of time at a given sintering temperature and how it affects density and strength. A mixture of 70 wt. % −100 mesh ferrotungsten (−150 microns) and 30 wt. % iron powder, combined as described above and compacted to form balls having a diameter 0.197 inch. These were sintered at a temperature near 1540° C. for 30, 60 and 240 minutes, after which density and crushing load were measured. Data are given in Table 10.

TABLE 10

| Sintering temp °C. | Time minutes | Density g/cc | Crushing load, lb |
|---|---|---|---|
| 1540 | 30 | 10.64 ± .08 | 685 ± 103 |
| 1537 | 60 | 10.65 ± .05 | 595 ± 72 |
| 1538 | 240 | 10.53 ± .08 | 570 ± 70 |

From this data, there is no statistical difference attributable to sintering time, in the range of 30 minutes to 4 hours, for a sintering temperature near 1540° C., and for a mixture containing 30 wt. % iron.

EXAMPLE 12

This experiment illustrates the effect of the method of removing the binder before sintering. The two techniques used are removal of binder by heating in hydrogen or by heating in a vacuum. Balls of diameter 0.197 inch were pressed from a mixture of −100 mesh ferrotungsten, 70 wt. %, and iron powder, 30 wt. % as described above, and subjected to removal of the binder by either under vacuum as described in Example 8, or in hydrogen at 1 atmosphere pressure by heating to 500° C. in 2.5 hours and holding at 500° C. for 0.5 hour. Results of the two procedures are given in Table 11.

TABLE 11

| Sintering temp °C. | Binder removal means | Density g/CC | Crushing load, lb |
|---|---|---|---|
| 1537 | in vacuo | 10.65 ± .05 | 595 ± 72 |
| 1538 | in flowing hydrogen | 10.52 ± .10 | 545 ± 44 |

From the data in Table 11, the values for both density and crushing strength are identical within experimental error. Thus, it is concluded that the two means of removing Acrawax binder are equivalent.

In conclusion, on the pressing of powder embodiment, it appears that densities of about 95% of theoretical density and comparable crushing loads can be achieved if the balls are sintered at about 1537° C. in the form of a mixture of 30 wt. % iron and 70 wt. % ferrotungsten powder irrespective of whether the Acrawax binder is removed by hydrogen treatment or in vacuo.

EXAMPLE 13

This example illustrates the difference in properties of balls made from different lots of iron. A mixture of −100 mesh ferrotungsten (83% tungsten) was made with lots A and B of iron powder so that the mixtures contained 40 wt. % iron powder. They were pressed to 0.197 inch diameter balls, dewaxed in hydrogen and sintered at 1550° C. for 1 hour. The results are set forth in Table 12.

TABLE 12

| | Lot A | Lot B |
|---|---|---|
| Iron Powder Properties | | |
| wt. % retained on 325 mesh (45 microns) | 0.8 | 5.7 |
| density gm/cc | 2.96 | 3.04 |
| carbon | <0.1% | <0.1% |
| sulfur | 0.027% | 0.027% |
| hydrogen loss | 0.48% | 0.32% |
| Ball Properties | | |
| density gm/cc | 10.98 ± 0.02 | 10.55 ± 0.10 |
| crushing load lb. | 943 ± 81 | 805 ± 26 |

The second Lot B gave a slightly inferior result, but still within acceptable specification. The difference is probably due to the larger amount of coarse material in Lot B.

EXAMPLE 14

This example illustrates an optimization to make a high density ball. A three component mixture was made of 50 wt. % −325 mesh ferrotungsten containing 78.3% tungsten from H. C. Starck; 25 wt. % grade C-5 tungsten powder from Teledyne Advanced Materials, and 25 wt. % grade R-1430 iron powder from International Specialty Products. This was pressed into 0.197 inch diameter balls and dewaxed as in Example 2 and sintered at 1550° C. for 60 minutes. The density was 11.98 gm/cc which is a significantly high value and is about 94% of the value expected if the material were free of pores. The crushing load was 553±138 lb.

In the preferred embodiments, the upper limit of the sintering temperature is near the solidus temperature of 1548° C. See T. B. Massalski et al., Binary Alloy Phase Diagrams, Vol. 2, pp. 1123–4, American Society for Metals (1986). If one operates much above this temperature, a significant fraction of the ball is liquid and the ball with slump back or stick to its neighbors or to the sintering boat. It is more difficult to define the low temperature limit, which should be high enough to form a material consisting primarily of an intermetallic compound of tungsten and iron. In the case of a 40 wt. % iron and above, it is probably near 1470° C. but below this iron content it will probably be higher, probably near 1500°–1520° C.

These examples, while not inclusive, suffice to show that tungsten-iron, ferrotungsten-iron, and tungsten-copper mixtures may be sintered to produce pellets of size comparable to shot-shell pellets, with densities comparable with those of the lead alloys now in common use, and with strengths that will ensure their integrity during discharge from the shotgun, during flight and on impact with the target. Furthermore, comparison of the photomicrographs (FIG. 4, FIG. 5) of samples from runs 13 and 4, examples 5 and 2, sintered at low and high temperature respectively and of the corresponding X-ray phase identification (Table 2), indicate that while high-temperature sintering results in compound formation, low-temperature sintering yields largely a mixture of elements, with tungsten in an iron matrix.

Shot pellets were subjected to a crushing test by confining them, singly, between two parallel, hard steel plates and applying a force perpendicular to the plates until the pellet crushed. The force in pounds necessary to crush the ball, called the crushing-strength, is given in Table 2. Density was determined from mass and calculated volume and by the Archimedean method, using water as the immersion liquid. Density based on calculated volume is deemed more reliable, because of the connected porosity of many specimens.

Some samples of sintered shot were ground to remove the pressing-belt and finished to 0.180" diameter, using a Cincinnati Bearing Grind machine.

Shot was tested for penetration and patterning efficiency by substituting an equal mass of the experimental iron-tungsten shot for the shot in commercially-loaded 12-bore, 2¾-inch cartridge, which originally held a load of 1⅛ oz. of steel BB shot. The cartridges were shot using a cylinder-bore (i.e., unchoked) barrel. In order to compare the performance of the iron-tungsten shot with that of commercially available shot, cartridges that were factory-loaded with steel BB shot, Steel T-shot, and lead BB shot were also fired. Penetration tests were done using both as-sintered and ground shot at a range of 20 yards, using a series of ¼-inch thick exterior grade fir plywood sheets, placed in a frame to hold them ¼-inch apart, and perpendicular to the trajectory of the shot. One set of plywood sheets was used for each cartridge fired. After each shot, the number of holes in each penetrated sheet was determined, and the number of pellets embedded in the last sheet was counted. The average depth of penetration into the last sheet was estimated, and the overall penetration given as the sum of the number of sheets penetrated by at least 90% of the shot, plus the fraction of the thickness of the final sheet penetrated by the shot. Thus a penetration of 2¼ means that at least 90% of the shot penetrated the second sheet, and the average penetration of the shot into the third sheet was one-quarter of its thickness, or about 1/16 inch. A sequence of numbers such as 1–51, 2–45, 3–39 means that 51 pellets penetrated the first sheet, 45 the second, and that 39 were embedded in the third.

Data about the performance of the various kinds of shot that were tested are given in Table 3. This table gives many data, including the number of shot which penetrated each plywood sheet, and which were found embedded in the final sheet for each round fired. The table also gives information about the pattern density obtained with a full coke barrel, and quotes comparable data for a commercially-available load.

The data of the table show that the iron-tungsten shot gives much superior penetration to that of either steel or lead of comparable size, as commercially loaded. Further, no damage was observed in the barrels in which the iron-tungsten shot was fired, even though 15 rounds of iron-tungsten shot were fired through the cylinder bore barrel, and ten through the full-coke barrel, which was of stainless steel.

Further, it has been learned that shot can be cast from the alloys described herein under specific conditions, further described hereinafter, that perform suitably as lead shot and steel shot substitutes in shot shells.

Experiments have demonstrated that adding carbon (2.5%) to 60 Fe 40W alloy caused the molten droplets to shatter into smaller spheres upon impact with water, producing a desirable distribution of shot sizes with average bulk densities of 10.1 g/cm$^3$. Later experiments evaluated different methods of dispersing molten alloy droplets into water for two different alloys: 57.5Fe 40@ 2.5C and 51.5Fe 46W 2.5C. Input material was pure W powder and Sorel iron (4.3%C). The densities of the resulting products were 10.0 and 10.2 g/cm$^3$, respectively. Other experiments demonstrated that ferro-tungsten could be readily substituted for pure W and that varying funnel orifice diameter and quench medium (water vs. brine) would be employed to control product size distributions. The presence of internal cracks in the brine-quenched product indicates that this quench medium yields an excessively high cooling rate. Additional refinements in process technology can be done using drop towers as disclosed by Bliemeister in U.S. Pat. Nos. 2,978,742 and 3,677,669, the subject matter of which is incorporated herein by reference.

EXAMPLE 15

Using 40% of pure W and 60% Sorel iron (4.3%C), molten alloy was passed through a porcelain sieve with 0.060" dia. holes and allowed to fall in air for about six (6) feet into a bucket of water (≈14" deep). The molten streams shattered upon impact with the water, producing size distributions of shot typical of that shown in Table 13.

TABLE 13

| SIZE*, mesh | WT., g | WT. % |
|---|---|---|
| +5 | 221.7 | 26.3 |
| −5 | 455.0 | 54.0 |
| +10 | | |
| −10 | 74.6 | 8.9 |
| +14 | | |
| −14 | 74.3 | 8.8 |
| +20 | | |
| −20 | 16.4 | 2.0 |
| TOTAL | 842.0 | 100.0 |

*For reference, mesh size relates to particle diameter in inches as: 5M = 0.157"; 10M = 0.065"; 14M = 0.0555"; 20M = 0.033".
Shotgun sizes: #7½ = 0.095"; #6 = 0.110"; #4 = 0.130"; #2 = 0.150"; BB = 0.180.

It was observed that much of the shot was agglomerated due to incomplete solidification as the shot piled up on itself in the bottom of the bucket. A sample of unagglomerated shot had an average bulk density of 10.12 g/cm$^3$. Actual carbon assay of the product was 2.52=2.55%, very close the calculated assay of 2.58%. It was very difficult to accurately measure pouring temperature, but the estimate was ≈1350° C.

A fixture was devised consisting of a graphite funnel suspended above a steel sleeve which in turn was positioned above a water-quenching tank with a sloped bottom. The steel sleeve was equipped with a "spider" so that molten metal could be "splattered" onto a ceramic pedestal to shatter the stream into droplets contained by the steel sleeve. Using this apparatus with and without the ceramic pedestal, six (6) experiments were conducted to evaluate two different funnel apertures (0.090" and 0.125"). In addition, two experiments (Runs #6 and #8) were run in which molten alloy was poured into a high-velocity water stream ("granulator"). As shown in Table 14, Run #7 is equivalent to Run #1 except for higher W concentration in the former. This was done in an attempt to obtain higher density. In all cases, Sorel iron was alloyed with pure W powder as feed.

TABLE 14

| Run | Fe (lbs) | W (lbs) | Brick | Aperture (in) | Free Fall (in) | Furnace (Temp C.) | Comments |
|---|---|---|---|---|---|---|---|
| 1 | 9.90 | 6.60 | No | (1) 0.125 | 93 | 1513 | 40 W |
| 2 | 9.65 | 4.65 | No | (1) 0.090 | 93 | 1532 | 40 W |
| 3 | 8.60 | 5.76 | Yes | (1) 0.125 | 79 | 1578 | 40 W |
| 4 | 7.30 | 4.90 | Yes | (1) 0.125 | 52 | 1473 | 40 W |
| 5 | 8.50 | 5.70 | No | (5 ea) 0.125 | 93 | x | 40 W |
| 6 | 8.30 | 5.60 | x | x | x | x | granulator, 40 W, hi flow |
| 7 | 8.90 | 7.55 | No | (3 ea) 0.125 | 93 | 1490 | 46 W |
| 8 | 9.25 | 6.20 | x | x | x | x | granulator, 40 W, lo flow |

Observations made during casting include:

(1) "Spattering" from a ceramic pedestal produced undesirably fine particle sizes.

(2) Granulation by water jet produced non-spherical parties.

(3) Actual casting temperatures were approximately 1325°–1350° C. with furnace-funnel transfer times of 30–60 sec.

Table 15 presents size distributions for all eight experiments obtained by screening through 5-, 6-, 7-, 8- and 10-mesh screens. Most products from Runs 1, 3, 4, 5 and 7 were generally spherical, although +5-mesh fractions again consisted of agglomerated particles, indicating that water depth (≈16") was inadequate. Particles from Run #2 were somewhat "pancake" shaped, whereas "granulated" particles from Runs 6 and 8 were quite "irregular" in shape.

TABLE 15

| Test | 1 | 2 | 3 | 4 | 5 | 6 (gran) | 7 | 8 (gran) |
|---|---|---|---|---|---|---|---|---|
| +5M | 42.48 | 35.90 | 41.43 | 35.34 | 64.81 | 10.42 | 54.71 | 20.93 |
| −5 +6 | 12.30 | 14.22 | 6.93 | 5.27 | 7.88 | 4.70 | 11.49 | 3.77 |
| −6 +7 | 14.52 | 16.03 | 7.97 | 5.83 | 7.80 | 5.89 | 10.44 | 6.75 |
| −7 +8 | 8.45 | 10.30 | 5.27 | 6.37 | 5.13 | 6.52 | 6.86 | 9.99 |
| −8 +10 | 6.58 | 7.42 | 4.86 | 6.29 | 3.83 | 6.54 | 5.38 | 10.63 |
| −10 | 15.66 | 16.13 | 33.55 | 40.9 | 10.55 | 65.93 | 11.12 | 47.94 |
| Total Wt., g | 1607.3 | 4275.6 | 1901.6 | 559.9 | 7178.8 | 6138.0 | 2261.9 | 279.55 |
| *−5 +10 | 41.85 | 47.97 | 25.03 | 23.76 | 24.64 | 23.65 | 36.17 | 31.14 |

*Potential "product" in shotgun size range.
5M = 0.157"
6M = 0.132"
7M = 0.111"
8M = 0.0937"
10M = 0.0787

Average bulk densities for the 40% W and 46% alloys were 10.0 g/cm$^3$ and 10.22 g/cm$^3$, respectively. An actual analysis of the 46% alloy (Run 7) showed it to be 43.5% W, indicating incomplete dissolution of the W powder:

| | | | |
|---|---|---|---|
| W | 43.5% | As | 2.8 ppm |
| C | 2.5% | Sb | <1 ppm |
| Si | 3330 ppm | Bi | <1 ppm |
| Mn | 890 ppm | Pb | 13 ppm |
| P | 450 ppm | Sn | 6.1 ppm |
| S | 68 ppm | Mo | <100 ppm |
| Cu | 160 ppm | | |
| Ni | 800 ppm | | |
| Cr | 210 ppm | | |

Photomicrographs of typical pellets from two different size fractions of the 46% W alloy (Run 7) were made. Carbides were visible as are micropores formed by shrinkage during solidification.

EXAMPLE 16

Seven different experiments were conducted for each of two alloys made by blending −¼" crushed ferro-tungsten (analysis per Table 7 below) and Sorel iron:

Alloy A—58Fe 40W 2C

Alloy B—53.2Fe 45W 1.8C

Calculations based on the 77.75%W content of ferro-tungsten established ferro/Sorel charge ratios of 1.0833 for Alloy A and 1.4038 for Alloy B.

TABLE 16

| Ferro-Tungsten Analysis | | | |
|---|---|---|---|
| W: | 77.75% | Cu: | 620 ppm |
| Si: | 0.168% | As: | 360 ppm |
| S: | 500 ppm | Sn: | 250 ppm |
| P: | 260 ppm | Pb: | 350 ppm |
| C: | 440 ppm | Sb: | 110 ppm |
| Mn: | 0.154% | Bi: | 200 ppm |

TABLE 17

Sorel Iron Analysis

C: 4.3%

S: 250 ppm, max.

Si: 0.40%, max.

Mn: 350 ppm, max.

P: 300 ppm, max.

For Runs 9 and 10, modified versions of Alloys A and B were made by adding 2% SiC powder to the charges. As shown in Table 18, residual metal skulls in the funnels from previous runs were used as "recycle" in certain subsequent runs.

TABLE 18

Charge Makeup

| Run | Weight, Sorel, lb. | Weight, Ferro-W, lb. | Weight, Recycle, lb. | Weight, SiC, lb | Total Weight, lb |
|---|---|---|---|---|---|
| 1 | 6.80 | 7.37 | 0 | 0 | 14.17 |
| 2 | 7.78 | 10.92 | 0 | 0 | 18.70 |
| 3 | 6.80 | 7.36 | 0 | 0 | 14.16 |
| 4 | 6.20 | 8.70 | 0 | 0 | 14.90 |
| 5 | 3.52 | 3.81 | 3.97 (Run 1) | 0 | 11.30 |
| 6 | 6.86 | 9.62 | 0 | 0 | 16.48 |
| 7 | 5.44 | 5.89 | 0 | 0 | 11.33 |
| 8 | 3.30 | 4.63 | 3.29 (Run 6) | 0 | 11.22 |
| 9 | 4.86 | 5.26 | 0 | 0.20 | 10.32 |
| 10 | 4.44 | 6.23 | 0 | 0.21 | 10.88 |
| 11 | — | — | — | — | — |
| 12 | — | — | — | — | — |
| 13 | 4.58 | 4.96 | 0 | 0 | 9.54 |
| 14 | 0 | 0 | 11.11 (var. runs) | 0 | 11.11 |

Table 19 is a summary of test conditions used for the 14 casting runs. Temperatures were measured in the SiC crucible just prior to its removal from the induction furnace. Transfer times from the furnace to the elevated pouring platform were held nearly constant at approximately 30 seconds. The drilled graphite funnels were preheated and maintained at approximately 1675° F. prior to pouring by means of a large gas torch. Based upon spot measurements, melt temperature was observed to drop by approximately 125° F. during transfer to the pouring platform and by an additional 290° F. after filling the funnel. The "casting temperature" estimates presented in Table 10 were arrived at by subtracting 415° F. from the furnace temperatures.

TABLE 19

Test Conditions

| Run | Alloy | Funnel Holes | Quench Medium | Furnace Temp, °F. | *Casting Temp, °F. |
|---|---|---|---|---|---|
| 1 | A | Single, 0.125" | water | 2850 | 2435 |
| 2 | B | " | water | 2868 | 2453 |
| 3 | A | " | 10% NaCl | 2930 | 2515 |
| 4 | B | " | 10% NaCl | 2879 | 2464 |
| 5 | A | " | 10% NaCl + high agit. | 2922 | 2507 |
| 6 | B | " | 10% NaCl + low agit. | 2886 | 2471 |
| 7 | A | 3 ea, 0.093" | 10% NaCl | 2873 | 2458 |
| 8 | B | " | 10% NaCl | 2910 | 2495 |
| 9 | A + 2% SiC | " | 10% NaCl | 2935 | 2520 |
| 10 | B + 2% SiC | " | 10% NaCl | — | — |
| 11 | A | 3 ea, 0.078" | 10% NaCl | — | — |
| 12 | B | " | 10% NaCl | — | — |
| 13 | A | 3 ea, 0.086" | 10% NaCl | 2917 | 2502 |
| 14 | B | " | 10% NaCl | 2947 | 2532 |

*Calculated (see text).

Graphite funnels were suspended above a stainless steel dumpster with a sloped bottom. In the present study, the dumpster was completely filled with water and was positioned to allow shot to free-fall 86" in air into 26" of water depth (as opposed to the 14" depth of the previous studies, which was found to be inadequate).

Product from the 14 runs was screened on 5-, 6-, 7-, 8- and 10-mesh screens to determine size distributions. Samples of the 56 fractions in the −5M/+10M range were mounted and polished for metallographic examination.

Results

Figure 4:
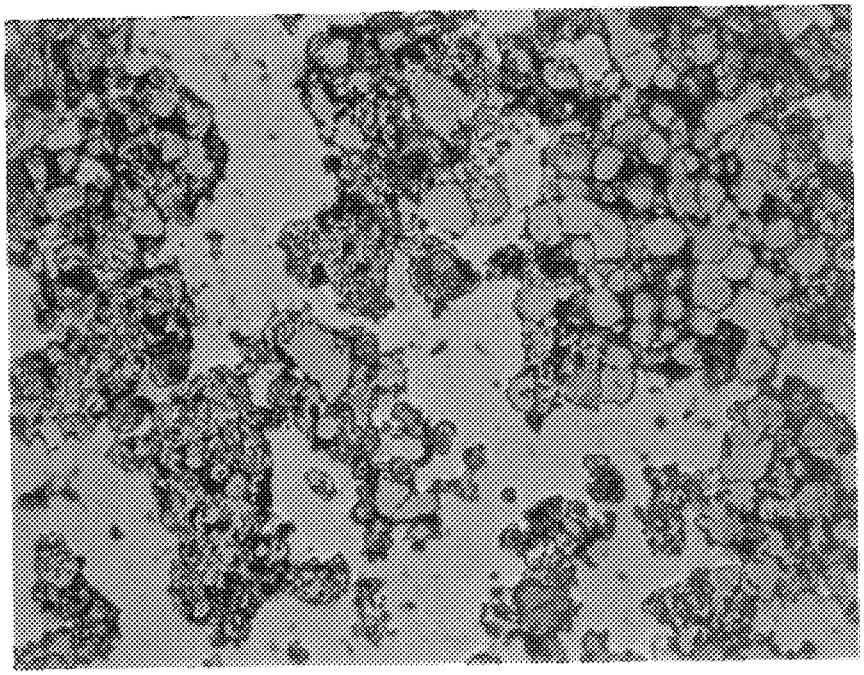
FIG. 4 is a photomicrograph of one embodiment of the present invention.

Table 20 and FIGS. 4 and 5 present particle size distributions of the 14 runs. FIG. 6 illustrates the influence of funnel orifice diameter on the percentage of potential product, i.e., particle size/distributions between 5-mesh (0.157") and 10-mesh (0.065"). An important factor to consider is that coarse (+5 mesh) particles were observed to form only from cold, viscous droplets obtained as the last metal exited the graphite funnel. These droplets do not shatter upon impact with the quenchant. The important point to note is that this scenario would not occur in a continuous operation where temperatures would be controlled under "steady state" conditions.

TABLE 20

Shot Size Distributions

| Tst | Alloy | Conditions | Total Wt., g | ←Weight Percentages→ +5 | −5 +6 | −6 +7 | −7 +8 | −8 +10 | −10 | *−5 +10 |
|---|---|---|---|---|---|---|---|---|---|---|
| 1 | A | water, 0.125" dia. | 3145 | 57.85 | 9.91 | 11.41 | 7.14 | 4.78 | 8.88 | 33.24 |
| 2 | B | " | 2381 | 58.44 | 9.88 | 11.11 | 6.86 | 4.67 | 9.04 | 32.52 |
| 3 | A | brine, 0.125" dia. | 6126 | 50.72 | 12.29 | 12.46 | 8.26 | 5.58 | 10.69 | 38.59 |
| 4 | B | " | 4239 | 48.1 | 12.72 | 13.44 | 8.32 | 5.99 | 11.42 | 40.47 |
| 5 | A | agit. brine, 0.125" dia. | 3894 | 44.06 | 13.41 | 14.15 | 8.85 | 6.6 | 12.93 | 43.01 |
| 6 | B | " | 4050 | 42.86 | 13.86 | 14.0 | 9.15 | 6.94 | 13.21 | 43.95 |
| 7 | A | brine, 0.093" dia. | 5695 | 46.6 | 13.64 | 13.27 | 8.44 | 6.05 | 12.0 | 41.4 |
| 8 | B | " | 2429 | 38.97 | 14.33 | 15.15 | 9.68 | 7.14 | 14.74 | 46.3 |
| 9 | A+ SiC | " | 4500 | 33.63 | 15.52 | 16.42 | 12.35 | 8.39 | 13.69 | 52.68 |
| 10 | B+ SiC | " | 2763 | 32.46 | 17.34 | 16.72 | 11.09 | 8.26 | 14.13 | 53.41 |
| 11 | A | brine, 0.078" dia. | 3587 | 28.86 | 18.69 | 18.77 | 11.15 | 8.15 | 14.39 | 56.76 |

TABLE 20-continued

Shot Size Distributions

| Tst | Alloy | Conditions | Total Wt., g | ←Weight Percentages→ +5 | −5 +6 | −6 +7 | −7 +8 | −8 +10 | −10 | *−5 +10 |
|---|---|---|---|---|---|---|---|---|---|---|
| 12 | B | " | 1242 | 30.28 | 16.28 | 17.69 | 11.2 | 8.08 | 16.48 | 53.25 |
| 13 | A | brine, 0.086" dia. | 4890 | 42.87 | 14.66 | 14.83 | 9.38 | 6.75 | 11.52 | 45.62 |
| 14 | B | " | 2200 | 37.11 | 15.33 | 16.76 | 10.68 | 7.49 | 12.65 | 50.26 |

*Potential product size range.

Average bulk densities for the −6M/+7M fractions were determined by water displacement as presented in Table 21. Values in parentheses were additionally obtained by diameter measurements of ten pellets per sample.

TABLE 21

Pellet Densities (−6M/+7M)

| Run | 1 | 2 | 3 | 4 | 5 | 6 | 7 | 8 | 9 | 10 | 11 | 12 | 13 | 14 |
|---|---|---|---|---|---|---|---|---|---|---|---|---|---|---|
| Wt, g | 10.08 | 10.58 | 8.39 | 14.74 | 9.68 | 10.87 | 10.35 | 10.25 | 9.91 | 11.56 | 10.02 | 9.90 | 9.23 | 10.70 |
| Vol. $cm^3$ | 1.1 | 1.1 | 0.9 | 1.4 | 1.0 | 1.1 | 1.0 | 1.0 | 1.0 | 1.1 | 1.0 | 1.1 | 0.9 | 1.0 |
| ρ $g/cm^3$ | (10.3) 9.2 | (10.6) 9.6 | (10.5) 9.3 | 10.5 | 9.7 | 9.9 | 10.4 | 10.3 | 9.9 | 10.5 | 10.0 | 9.0 | 10.3 | 10.7 |

Bulk samples and metallographic mounts of all 56 size fractions between 5- and 10-mesh were examined by the inventor whose qualitative comments appear in Table 22.

TABLE 22

Particle Shape and Integrity (−5M/+10M)

| Run | Shape Description | Internal Integrity |
|---|---|---|
| 1 | generally spherical | some porosity, no cracks |
| 2 | generally spherical | some porosity, no cracks |
| 3 | generally spherical | some porosity, many cracks |
| 4 | generally spherical | some porosity, many cracks |
| 5 | many flattened pieces | some porosity, many cracks |
| 6 | many flattened pieces | some porosity, many cracks |
| 7 | generally spherical | some porosity, many cracks |
| 8 | generally spherical | some porosity, many cracks |
| 9 | many broken pieces, some flattened | some porosity, many cracks |
| 10 | many broken pieces, some flattened | some porosity, many cracks |
| 11 | generally spherical | some porosity, many cracks |
| 12 | generally spherical | some porosity, many cracks |
| 13 | generally spherical | some porosity, many cracks |
| 14 | generally spherical | some porosity, many cracks |

In comparison with the earlier experiments, far fewer agglomerated ("twins", "moon-planet", etc.) particles were observed. This was probably due to the fact that increased water depth was used in the present studies. Another qualitative observation is that larger spheres tend to be higher in porosity, some even appearing as hollow shells. We again attribute this to cold, viscous droplets near the end of a run which would not be encountered in a controlled, continuous operation.

Discussion of Results

A summary of the inventors' observations and opinions include:

1. Brine quenching in 10% NaCl, while having a beneficial effect on particle size, results in cooling rates so fast as to cause cracking within the parties.

2. Molten stream size, as determined by funnel orifice diameter, has a significant influence on particle size distribution. Smaller orifices tend to produce a higher percentage of desirable (for shotgun applications) sizes.

3. Quenchant agitation causes non-spherical particles to form during solidification. 4. Eliminating coarse (+5 mesh) particles by controlling temperature (and related viscosity) in a continuous process should place 75–85% of the product within the desired size range.

5. Particle shape and density must be addressed before declaring any particles to be final product.

6. Addition of 2% SiC to either alloy (A or B) produced visually fluid melts, but these alloys were quite brittle.

7. The 40% W and 45% W alloys did not appear to behave in significantly different ways. It is contemplated that it is possible to further increase W concentration (in order to increase density) and still retain castability at tolerable temperatures.

8. Ferro-tungsten is readily alloyed with Sorel iron.

These experiments appear to indicate that a scaled-up production process will be feasible. One skilled in this art would envision a continuous melting process in which two relatively small (e.g., 500 lb) induction furnaces supply a constant flow of molten alloy to a tundish equipped with ceramic orifices. Product would be easily removed from the quench tank by magnetic methods, followed by screening and shape/density separation methods commonly used by mineral and metallic shot industries. Acceptable product would be bled off, heat-treated and optionally final-ground. All non-product would be recycled back to the melting process.

A high recycle load to the melting process (e.g., 75%) should be tolerable.

In subsequent experiments, the inventor has explored the use of a slow quenching medium (0.05–0.10% polyvinyl alcohol in water), smaller funnel orifice diameter (0.078", 0.062" and 0.050"), and "high" (84") versus "low" (24") free-fall distances, with favorable results to those described herein.

The following Table 23 illustrates the effects of these variables on FeW particle-size distribution. Product evaluations are presently incomplete, but here are some preliminary observations.

TABLE 23

SIZE DISTRIBUTIONS

| TEST | % W | **CONDITIONS | TOTAL WT, g | WEIGHT PERCENTAGES +5 | −5 +6 | −6 +7 | −7 +8 | −8 +10 | −10 | *+5 +10 |
|---|---|---|---|---|---|---|---|---|---|---|
| M1 | 45 | 0.078, hi, 0.05 PVA | 496.6 | 6.0 | 13.9 | 27.8 | 22.3 | 11.3 | 18.7 | 75.3 |
| M2 | 45 | 0.062, hi, 0.05 PVA | 1143.2 | 21.6 | 19.3 | 25.4 | 12.3 | 7.7 | 13.7 | 64.7 |
| M3 | 45 | 0.050, hi, 0.05 PVA | 402.7 | 11.9 | 7.5 | 18.7 | 21.9 | 14.9 | 25.1 | 63.0 |
| M4 | 45 | 0.078, low, 0.05 PVA | 1070.9 | 67.5 | 16.1 | 10.6 | 2.6 | 1.3 | 1.9 | 32.5 |
| M5 | 45 | 0.062, low, 0.05 PVA | 1852.8 | 33.0 | 30.6 | 24.5 | 9.3 | 1.2 | 1.4 | 65.6 |
| +M6 | 45 | 0.059, low, 0.05 PVA | 52.4 | 9.7 | 15.9 | 28.4 | 21.1 | 16.3 | 8.6 | 81.7 |
| M7 | 45 | 0.078, low, 0.1 PVA | 529.1 | 75.3 | 14.2 | 6.4 | 1.9 | 1.0 | 1.2 | 23.5 |
| M8 | 45 | 0.062, low, 0.1 PVA | 1237.9 | 53.1 | 22.6 | 17.8 | 4.0 | 1.2 | 1.3 | 45.6 |
| +M9 | 45 | 0.078, hi, 0.1 PVA | 47.6 | 3.7 | 14.4 | 24.5 | 22.4 | 13.4 | 21.6 | 74.7 |
| +M10 | 45 | 0.062 hi, 0.1 PVA | 111.5 | 43.7 | 16.9 | 14.2 | 8.0 | 6.9 | 10.3 | 46.0 |
| M11 | 46.2 | 0.078, hi, 0.1 PVA | 2825.2 | 10.1 | 16.4 | 26.1 | 17.0 | 10.9 | 19.5 | 70.4 |

Shotgun-size "product": 5M(0.157")–10M(0.078")
+Insufficient sample size/low reliability
***"Conditions" refer to funnel orifice dia., free-fall distance, PVA concentration When compared against results of the previous experiments, slow quenching with PVA produced shot with markedly improved sphericity.

PVA quenching also resulted in finer particle size distributions than were obtained with, for example, fast brine quenching, all other known variables (e.g., melt temperature, orifice size, free-fall distance) being held constant. Product (−5M/+10M) yields with PVA quenching exceeded 70%, compared with ≦57% for brine quenching.

Free-fall distance (from bottom of sieve to quench liquid surface) has a significant effect on particle size distribution, a large drop resulting in increased shattering of the molten droplets upon impact and, therefore, a finer particle size distribution.

The following generalizations based on the data are believed to be valid.

Particle size distribution may be effectively controlled by varying funnel orifice size and, independently, by varying free-fall distance. In all experiments to date, a relatively wide spectra of sizes were obtained.

Particle shape (i.e., "sphericity") is strongly influenced by quench medium. This is primarily a function of the different cooling rates obtained during solidification determined by the various thicknesses of vapor blankets surrounding the particles.

The latest experiments were successfully performed using an alloy containing 46.2% W. This alloy was at 2953° F., as opposed to 2900° F. used for melting 45% W alloy. Calculated carbon content for this alloy is 1.72%. Melt fluidity was not noticeably lower in this alloy. The available ternary phase diagrams indicate that increasing carbon up to around 3.0–3.5% may allow casting of alloys containing perhaps as much as 60–65% W at temperatures of 1500°–1550° C.

The invention described herein can be practiced in a wide variety of ways utilizing tungsten, iron or copper, or zinc or aluminum or other suitable metal as either the primary or secondary metal to be utilized with tungsten. It will be appreciated that the steps employed together with the materials and conditions used in the sintering process can also be varied, depending on the projected properties, desired such as density and strength. For example, it has been demonstrated that smaller median particle size will increase density. Likewise, different temperature regions will produce different properties as described herein. Likewise, the selection of different quench media and sieve size and height can be varied as well as composition ranges including additions such as carbon to enhance desired particle size distributions from various temperatures of the molten material.

EXAMPLE 17

A series of 8 runs were conducted to pass a molten alloy of ferrotungsten plus Sorel iron having a composition on a weight basis of 52.3% Fe, 46% W, and 1.7% C through a SiC crucible having drilled orifices of 0.078" dia. with 3 holes per funnel. Three different heights of 84 inch, 54 inch and 24 inch were used and the molten metal fell into water containing 0.04% PVA. During the melting, gaseous argon was directed onto the top of the SiC crucible. As indicated in Table 24, certain metals were killed or deoxidized with Al or Hf immediately prior to removal from the furnace.

TABLE 24

Test Conditions

| Test Run | Free-fall Height, in. | Deox. Practice | Furnace Temp °C. |
|---|---|---|---|
| 1 | 84 | None | 1603 |
| 2 | 84 | Al (0.1%) | 1615 |
| 3 | 84 | Hf (0.5%) | 1639 |
| 4 | 54 | None | 1613 |
| 5 | 54 | Al (0.1%) | 1617 |
| 5R | 54 | Al (0.1%) | 1631 |
| 6 | 54 | Hf (0.5%) | 1648 |
| 7 | 24 | Al (0.1%) | 1631 |

Run 5R was a repeat of Run 5 to verify reproducibility.

The size distribution of the products are presented in Table 25. The focus in these experiments was on achieving smaller size shot and thus particles larger than 5 mesh (+5m) were not considered to be the desired product.

TABLE 25

| Test | Size Distributions Weight % of Total | | | | | | |
|---|---|---|---|---|---|---|---|
| Run | +5 m | −5+6 | −6+7 | −7+8 | −8+10 | −10 | −5+10 |
| 1 | 10.25 | 12.09 | 21.08 | 16.61 | 12.72 | 27.26 | 62.49 |
| 2 | 38.72 | 23.73 | 18.09 | 6.90 | 4.46 | 8.09 | 53.19 |
| 3 | 24.37 | 18.36 | 22.54 | 12.82 | 7.48 | 14.44 | 61.19 |
| 4 | 37.79 | 23.18 | 20.43 | 7.99 | 4.60 | 6.01 | 56.20 |
| 5 | 29.17 | 22.10 | 23.22 | 10.48 | 5.79 | 9.24 | 61.59 |
| 5R | 24.57 | 24.33 | 25.79 | 10.24 | 5.65 | 9.43 | 66.0 |
| 6 | 33.81 | 25.60 | 21.62 | 8.02 | 4.59 | 6.35 | 59.84 |
| 7 | 57.50 | 21.56 | 15.44 | 2.96 | 1.28 | 1.26 | 41.24 |

Due to the extensive degree of gas porosity in non-deoxidized and Hf-killed products, density values were not determined. The Al-killed products had densities between 9.6 g/cm$^3$ and 10.0 g/cm$^3$.

The +5m fraction of Run 5 was studied by XRD and found to contain two phase of ferritic iron and $Fe_3W_3C$. Although at least one available Fe-W-C phase diagram indicates that a third phase of WC may be present in small concentrations at a 1000° C. equilibrium, none was detected.

Table 26 presents a chemical analysis for the +5 mesh products from Runs 4, 5 and 6 where there was no deox, Al-killed and Hf-killed as well as a sample of the slag skimmed from the Run 5 melt.

TABLE 26

| Sample | Chemical Composition (ppm unless noted as %) W | C | O | N | H | Al | Hf | Si | Fe |
|---|---|---|---|---|---|---|---|---|---|
| +5 m #4 | 46.7 % | 2.21 % | 470 | 56 | 3 | <40 | 64 | 0.75 % | — |
| +5 m #5 | 45.1 % | 2.58 % | 180 | 73 | 5 | 620 | 27 | 0.71 % | — |
| +5 m #6 | 45.6 | 2.33 | 250 | 62 | <3 | 40 | <25 | 0.73 % | — |
| Slag#5 | 50.2 % | 1.24 % | 1.5 % | 240 | 58 | 0.14 % | <0.05 % | 1.18 % | 36.7 % |

These runs demonstrate the effectiveness of Al as a deoxidizer and its beneficial effect on gas porosity. Control over average product particle size by varying free-fall height was confirmed with the exception of the data point for Run 2 which was coarser than expected. It is speculated that this may be due to a delay in pouring which resulted in a somewhat cooler metal and thus possibly a more viscous metal during casting.

EXAMPLE 18

This example presents the result of two studies. The first was to scale up the amount of material produced according to Runs 5 and 5R of Example 17. The other study was to consider the effectiveness of the patented Air Liquide Corp. process of SPAL™ in preventing the dissolution of oxygen during melting.

The SPAL™ process consists of tricking liquid argon onto the top of the charge throughout the entire melting cycle. In most traditional ferrous alloys, there is very little oxygen pick up occurring during pouring through air subsequent to melting and thus the use of the SPAL™ process would be sufficient.

The experimental system consisted of pouring from the melt furnace into a rammed refractory-lined ladle. The ladle was elevated by means of a bridge crane and pouring was done into a sieve-bottomed graphite basin suspended at 74 inches above a water quench tank where the water contained 0.05% PVA. The product was collected in a shallow stainless steel box about 4 ft square at the bottom of the tank. The tank was a steel dumpster of about 44 inches deep, 51 inches wide by 72 inches long. The catch box was equipped with screened "windows" at each corner to allow drainage upon removal from the quench tank and during subsequent rinsing with water. Failure to remove all traces of PVA solution results in agglomerated product after drying, which is very difficult to break apart. Drying of the product was conducted in a circulating hot air oven at 200° F.

The graphite pouring basin/sieve assembly has a row of about 9–10 porcelain sieves. The stock sieve size of 0.080 inch dia. holes was plugged with mortar and then perforated to obtain the desired hole patterns. The pattern evolved from experience from the first four melts which had more closely spaced patterns and the final form was used with the last 9 melts.

The entire pouring basin/sieve assembly was wrapped with Kaowool except for the bottom surface which was preheated to 1,000°–1,100° C. with a propane torch prior to each casting run. The ladle was also propane heated to a somewhat lower temperature.

The Sorel iron and ferrotungsten raw material was used to formulate a 46.3% W alloy. Relatively small amounts were used. Aluminum (0.15%) was added to the ladle in the first two melts, but to the furnace in melts 3 and 4. Melts 5–13 were not Al-killed, but were protected by the SPAL™ process.

The melt data for the 13 runs is given in Table 27.

TABLE 27

| Melt Data | | | | | |
|---|---|---|---|---|---|
| Run | Input Wt. lb | Product Wt. lb | Furnace Temp °C. | Quench* Temp °C. | Deox |
| 1 | 150 | 83 | 1650 | 18 | Al to ladle |
| 2 | 306 | 201 | 1606 | 19.5 | Al to ladle |
| 3 | 304 | 66 | 1616 | 27 | Al to ladle |
| 4 | 301 | 49 | 1677 | 24 | Al to ladle |
| 5 | 300 | 173 | 1617 | 31 | SPAL |
| 6 | 303 | 142 | 1621 | 32 | SPAL |
| 7 | 302 | 68 | 1609 | 37 | SPAL |
| 8 | 301 | 291 | 1770 | 30 | SPAL |
| 9 | 300 | 97 | 1662 | 43 | SPAL |
| 10 | 307 | 242 | 1750 | 41 | SPAL |
| 11 | 155(recycle) 83(virgin) | 71 | 1770 | 34 | SPAL |
| 12 | 150(recycle) 83(virgin) | 207 | 1740 | 37 | SPAL |
| 13 | 304(recycle) | 94 | — | 48 | SPAL |
| Total | 3040(virgin) | 1784 | | | |

*Initial Quench in water, solution depth from 39–42 inches

TABLE 28

Size Distribution

| Size Run # | Weight Percent +3 m | −3 m +4, | −4 m +5 m | −5 m +6 m | −6 m +7 m | −7 m +8 m | −8 m +10 m | −10 m | Total Wt. g |
|---|---|---|---|---|---|---|---|---|---|
| 1/16 #1 | 14.06 | 17.63 | 12.06 | 12.10 | 13.54 | 9.34 | 7.19 | 14.08 | 2136.2 |
| 1/32 #2 | 17.56 | 18.29 | 8.90 | 10.69 | 13.54 | 10.61 | 8.29 | 17.13 | 2596.4 |
| 1/8 #3 | 17.59 | 14.63 | 9.80 | 11.02 | 12.97 | 10.03 | 7.38 | 16.59 | 3316.7 |
| 1/16 #4 | 15.50 | 13.01 | 9.35 | 11.15 | 13.34 | 10.89 | 8.59 | 18.17 | 1366.2 |
| 1/32 #5 | 9.02 | 11.60 | 11.27 | 13.55 | 15.79 | 12.11 | 8.51 | 18.14 | 2725.2 |
| 1/32 #6 | 36.34 | 14.56 | 9.90 | 8.77 | 8.58 | 6.23 | 4.54 | 11.09 | 2071.9 |
| 1/16 #7 | 5.86 | 17.80 | 14.72 | 12.33 | 13.79 | 10.88 | 7.90 | 16.72 | 1588.5 |
| 1/32 #8 | 19.40 | 16.29 | 11.74 | 13.04 | 11.91 | 8.52 | 5.69 | 13.41 | 4133.5 |
| 1/16 #9 | 0.89 | 8.69 | 10.96 | 14.22 | 17.26 | 13.65 | 10.63 | 23.72 | 2650.4 |
| 1/32#10 | 4.22 | 11.64 | 10.39 | 14.06 | 17.51 | 12.66 | 9.43 | 20.09 | 2897.4 |
| 1/16#11 | 7.05 | 12.94 | 11.24 | 14.01 | 15.45 | 11.32 | 8.98 | 19.0 | 1972.2 |
| 1/32#12 | 17.84 | 17.38 | 9.87 | 12.17 | 12.27 | 9.00 | 6.56 | 14.91 | 2462.1 |
| 1/16#13 | 6.41 | 11.57 | 11.89 | 13.31 | 15.36 | 11.74 | 9.01 | 20.71 | 2534.2 |
| Average | 13.21 | 13.92 | 10.93 | 12.34 | 13.95 | 10.54 | 7.90 | 17.22 | — |

TABLE 29

Chemical Composition and Density

| Run | Al % | C % | Fe % | N ppm | O ppm | Si % | W % | Density g/cm$^3$ |
|---|---|---|---|---|---|---|---|---|
| 1 | 0.15 | 1.56 | 57.9 | 45 | 460 | 0.23 | 41.8 | 9.56 |
| 2 | 0.16 | 1.67 | 56.0 | 48 | 860 | 0.11 | 43.8 | 9.67 |
| 3 | 0.16 | 1.63 | 54.7 | 38 | 690 | 0.11 | 45.0 | 9.60 |
| 4 | 0.15 | 1.59 | 53.0 | 40 | 720 | 0.12 | 46.7 | 10.1 |
| 5 | <0.01 | 1.52 | 59.2 | 55 | 760 | 0.12 | 40.7 | 8.58 |
| 6 | <0.01 | 1.82 | 54.3 | 57 | 1350 | 0.071 | 45.6 | 8.64 |
| 7 | <0.01 | 1.55 | 55.5 | 49 | 530 | 0.081 | 44.4 | 8.73 |
| 8 | <0.01 | 1.59 | 52.0 | 41 | 870 | 0.093 | 47.9 | *(9.54) 7.85 |
| 9 | <0.01 | 1.65 | 53.8 | 36 | 550 | 0.12 | 46.1 | 8.69 |
| 10 | <0.01 | 1.58 | 50.6 | 45 | 1210 | 0.10 | 49.3 | 8.4 |
| 11 | <0.01 | 1.78 | 59.6 | 43 | 420 | 0.10 | 40.3 | *(9.98) 8.0 |
| 12 | <0.01 | 1.65 | 52.6 | 42 | 480 | 0.074 | 47.3 | 8.3 |
| 13 | <0.01 | 1.72 | 59.6 | 48 | 580 | 0.053 | 40.4 | 8.2 |

*Density values shown in parenthesis represents cast plugs taken from the melt before tapping.

The data from Table 29 indicates that while the SPAL™ process adequately protects the alloy during melting, gas porosity results from pouring FeW alloy through the air. Densities on non Al-killed runs 5–13 are unacceptably low. The Fe+W total for all 13 groups are 99–100% indicating that the variations in W content are real and probably result from alloy inhomogeneity.

EXAMPLE 19

This example sets forth experiments run to produce coarser shotgun sizes such as #2 shot having a 0. 15 inch diameter. The products from Example 11 were remelted and the W content was increased to 50% and 55% by adding pure W powder to the 46.3% alloy. Both the SPAL™ process and Al-killing (0.15%) were used to minimize gas porosity. The free-fall height was reduced to 24 inches to obtain coarser distributions.

Using the equipment described in Example 18, there were 12 runs made as set forth in Table 30.

TABLE 30

Melt Data

| Run | W % | Furnace Temp °C. | PVA % | Comments |
|---|---|---|---|---|
| 1 | 50 | 1709 | 0.05 | |
| 2 | 55 | 1704 | 0.025 | |
| 3 | 55 | 1673 | 0.025 | |
| 4 | 55 | 1683 | 0.025 | |
| 5 | 55 | 1670 | 0.025 | |
| 6 | 55 | 1720 | 0.025 | pump agitated |
| 7 | 55 | 1730 | 0.025 | impeller agitated |
| 8 | 55 | 1730 | 0.025 | |
| 9 | 55 | 1717 | | Deep tank |
| 10 | 55 | 1760 | | Deep tank, 0.095 inch sieves on each end of row |
| 11 | 55 | 1705 | | Deep tank |
| 12 | 55 | 1730 | | Deep tank, 0.095 inch sieves on each end of row |

During the runs it was observed that the higher W content and the higher melting point appeared to make the alloy more difficult to pass through the sieve and also more of the +3 mesh agglomerate were formed. The process was changed during the course of the runs as noted in Table 30 above. After run 1, the PVA concentration was reduced from 0.05% to 0.025% in an attempt to reduce the volume of vapor created during quenching. On run 6, the top region of the quench medium was agitated by means of a pump in an attempt to break up the vapor pocket. In run 7, more vigorous agitation was effected in the top region of the bath by means of an impeller.

In runs 9–12, an 8 yd$^3$ dumpster was substituted for the previous 4 yd$^3$ dumpster. This doubled the volume of the quench medium and increased the liquid depth from 42 inches to 82 inches. In an attempt to allow molten alloy to flow more freely at the ends of the row of sieves, 0.095 inch diameter sieve sections were substituted for the 0.080 inch diameter end sections on runs 10 and 12. The size distribution and density of the products is set forth in Table 31.

TABLE 31

Size Distribution and Density

| Run | Weight Percent* −3 m +4 m | −4 m +5 m | −5 m +6 m | −6 m +7 m | −7 m +8 m | −8 m +10 m | −10 m | Sample Wt. g | Density g/cm$^3$ |
|---|---|---|---|---|---|---|---|---|---|
| 1 | 23.4 | 19.9 | 19.3 | 17.3 | 10.1 | 5.2 | 4.3 | 2820.5 | (50% W) 10.33 |
| 2 | 26.7 | 22.0 | 18.8 | 15.8 | 7.5 | 4.0 | 4.9 | 1985.6 | 10.82 |
| 3 | 29.0 | 20.0 | 19.9 | 14.0 | 7.4 | 4.2 | 5.5 | 2251.9 | 11.08 |
| 4 | 22.6 | 22.3 | 20.6 | 17.1 | 8.9 | 3.8 | 4.7 | 2017.2 | 11.34 |
| 5 | 28.1 | 19.7 | 17.6 | 15.3 | 3.9 | 4.8 | 5.6 | 1262.8 | 11.20 |
| 6 | 25.1 | 20.8 | 18.8 | 16.5 | 9.4 | 4.3 | 5.1 | 1937.2 | 11.36 |
| 7 | 32.8 | 20.7 | 16.2 | 13.6 | 7.2 | 4.1 | 5.4 | 2998.1 | 11.20 |
| 8 | 22.9 | 19.8 | 18.8 | 16.0 | 10.5 | 5.3 | 6.7 | 2702.2 | 11.03 |
| 9 | 29.4 | 19.6 | 19.5 | 14.9 | 8.1 | 3.5 | 4.7 | 2541.2 | 11.06 |
| 10 | 30.7 | 20.0 | 17.5 | 14.3 | 7.9 | 4.3 | 5.3 | 2673.9 | 11.04 |
| 11 | 31.1 | 21.0 | 17.7 | 14.2 | 7.1 | 4.0 | 4.9 | 1570.1 | 11.14 |
| 12 | 25.2 | 20.3 | 16.5 | 17.3 | 5.9 | 5.5 | 6.3 | 2404.4 | 10.80 |
| Avg. | 27.25 | 20.5 | 18.35 | 15.5 | 8.5 | 4.4 | 5.3 | — | (55% w) 11.09 |

*All +3 mesh material was excluded/recycled.
The density was determined by water displacement method on a sample of about 200 g of mixed sizes.

TABLE 32

Mass Balances

| Run | Wt Melted, lb. | Wt. thru Sieve, lb. | Wt +3 m, lb. | Wt Product −3 m, lb. |
|---|---|---|---|---|
| 1 | 241.4 | 192.8 | 91.2 | 101.6 |
| 2 | 349.4 | 234.7 | 95.5 | 139.2 |
| 3 | 334.1 | 131.5 | 46.5 | 85.0 |
| 4 | 308.8 | 35.9 | ¯1.0 | 34.9 |
| 5 | 289 | 63.8 | ¯7.0 | 56.8 |
| 6 | 331.5 | 109.9 | 35.5 | 74.4 |
| 7 | 357.5 | 194.7 | 78 | 116.7 |
| 8 | 288.1 | 42.2 | ¯1.0 | 41.2 |
| 9 | 286.4 | 80.1 | 36 | 44.1 |
| 10 | 292.5 | 177.6 | 74.5 | 103.1 |
| 11 | 362 | 64.8 | 33 | 31.8 |
| 12 | 353 | 118.1 | 38 | 80.2 |
| Total | 3,793.7 | 1,446.2 | 537.2 | 909.0 |

The data in Table 32 illustrates that it was often difficult to obtain large flows of molten 55% W alloy through the sieves before plugging occurred and that large percentages of +3 mesh agglomerates were obtained in some runs.

Shadow images of the particle shape for the particles have also been examined. When an attempt was made to separate particles from each other, the particles that appeared to be touching were, in fact, agglomerated "twins," triplets," etc. This shape distribution is not desirable for obtaining the desired uniform particle sizes for producing ground spherical shot.

EXAMPLE 20

This example illustrates a casting method to produce uniform size particles which can be ground to produce shot.

Porcelain sieves with 0.080 inch diameter holes were sealed on one major surface with mortar. A powder mixture of 30% Fe, 68.5% Starck ferro-tungsten (82.9% W, −325 mesh) and 1.5% paraffin was poured into the top, unsealed, surface of the sieve. The filled sieve was manually vibrated and leveled by scraping excess powder off with a putty knife. The packed sieves were partially covered with a graphite plate to minimize oxidation of the powder and placed in a resistance furnace with 1700° C. max. Kanthal elements.

The filled sieves were given the following thermal cycle to melt the powder mixture. First, a ramp to 1600° C. at 50° C./min. Then they were held for 30 minutes at 1600° C. followed by a furnace cool to about 1200° C. Finally, they were air cooled to room temperature.

The fully loaded sieves each contained about 56 g of powder at a tap density of about 4.0 g/cm. After melting and solidification, the as-cast density was measured on a 71 g sample as 10.92 g/cm$^3$ by the water-displacement method. The cast right cylinders produced in the central, graphite-protected regions of the sieves were relatively uniform in shape with the variation in length being the result of variable mortar thickness in the sieve bottom.

It is contemplated that this batch process could be scaled up and automated. The process is suitable to using the large quantities of grinding dust that is generated with spherical grinding operation required for either granulated/cast or powder metallurgy products. These fines could be used as the input material according to this process.

When grinding particles to make spherical shot, any uniform size particle can be ground including the right cylinders made in these sieves. However, even more optimum results can be achieved by applying a given weight of material to depressions machined into the surface of a flat mold. Upon melting, each liquid drop will form a pseudo-sphere, due to the surface tension and the shape of the bottom of the depression. It is contemplated that the particles would presumably be uniform in size and shape and easily grindable.

The process will be easy to automate. Either endless belts or rotating wheels would continually advance through a stage of die-filling, melting, cooling and discharge. The temperature control would not be of much concern as there is practically no upper limit. The process cycles for the machinery could be quite short because there is no reason to allow permanent molds to cool much below the alloy melting point before refilling.

The invention is therefore only to be limited to the scope of the claims interpreted in view of the applicable prior art.

What is claimed is:

1. A shot pellet or small arms projectile having a specific gravity of at least about 10 gm/cc comprising 40% by weight to 65% by weight Tungsten and from 60% by weight to 35% by weight iron prepared by sintering tungsten containing powders having median particle sizes of 150 microns or less at a temperature sufficient to form a material consisting primarily of an intermetallic compound of tungsten and iron.

* * * * *